US011793711B2

(12) United States Patent
Bailey et al.

(10) Patent No.: US 11,793,711 B2
(45) **Date of Patent: *Oct. 24, 2023**

(54) DEVICES FOR SEXUAL STIMULATION

(71) Applicant: ZUMIO INC., Ottawa (CA)

(72) Inventors: Kevin Bailey, Ottawa (CA); Olga Reimer, Austin (CA)

(73) Assignee: ZUMIO INC., Ottawa (CA)

( * ) Notice: Subject to any disclaimer, the term of this patent is extended or adjusted under 35 U.S.C. 154(b) by 280 days.

This patent is subject to a terminal disclaimer.

(21) Appl. No.: 17/196,144

(22) Filed: Mar. 9, 2021

(65) Prior Publication Data

US 2021/0186799 A1 Jun. 24, 2021

Related U.S. Application Data

(63) Continuation of application No. 15/577,890, filed as application No. PCT/IB2016/053151 on May 27, 2016, now Pat. No. 10,952,922.

(60) Provisional application No. 62/168,479, filed on May 29, 2015.

(51) Int. Cl.
*A61H 19/00* (2006.01)

(52) U.S. Cl.
CPC ..... *A61H 19/44* (2013.01); *A61H 2201/0153* (2013.01); *A61H 2201/0188* (2013.01); *A61H 2201/1215* (2013.01); *A61H 2201/1671* (2013.01); *A61H 2201/1685* (2013.01); *A61H 2201/5007* (2013.01); *A61H 2201/5043* (2013.01)

(58) Field of Classification Search
CPC ..... A61H 19/44; A61H 2201/0153; A61H 2201/0188; A61H 2201/1215; A61H 2201/1671; A61H 2201/1685; A61H 2201/5007; A61H 2201/5043; A61H 19/00; A61H 19/34; A61H 2201/1207; A61H 2205/087; A61H 21/00; A61H 23/02; A61H 2201/1664; A61H 2201/1669; A61H 2201/1673; A61H 2201/1676

See application file for complete search history.

(56) References Cited

U.S. PATENT DOCUMENTS

| | | | | |
|---|---|---|---|---|
| 6,190,307 | B1 * | 2/2001 | Tsai | A61H 19/34 601/51 |
| 10,952,922 | B2 * | 3/2021 | Bailey | A61H 19/44 |
| 2009/0198158 | A1 * | 8/2009 | Nan | A61H 23/0254 601/87 |
| 2015/0148592 | A1 * | 5/2015 | Kanbar | A61H 19/34 600/38 |

* cited by examiner

*Primary Examiner* — Quang D Thanh
(74) *Attorney, Agent, or Firm* — Andrews Robichaud PC; Alessandro Colonnier

(57) ABSTRACT

An example sexual stimulation device includes a drive module, a stimulating element, a fulcrum, and a compliant member. The stimulating element has a first end coupled to the drive module in a manner such that the first end of the stimulating element moves along a first path when the drive module is operated. The stimulating element also has a second end opposite the first end. The fulcrum is disposed at a first point along an extension of the stimulating element such that the stimulating element pivots about the first point and the second end of the stimulating element translates according to a second path. The compliant member is coupled to the second end of the stimulating element.

19 Claims, 20 Drawing Sheets

DEVICES FOR SEXUAL STIMULATION

CROSS-REFERENCE TO RELATED APPLICATIONS

This application is a continuation of application Ser. No. 15/577,890 filed Nov. 29, 2017, which is a 371 of international PCT Application No. PCT/IB2016/053151 filed May 27, 2016, which claims priority to Application No. 62/168,479 filed May 29, 2015, the disclosures of which are incorporated herein in their entirety by reference.

TECHNICAL FIELD

This disclosure relates to devices used for sexual stimulation.

BACKGROUND

Objects or devices used for sexual stimulation (commonly known as "sex toys") can be used to facilitate sexual arousal and orgasm. In many cases, sex toys can provide sexual pleasure by stimulating a user's erogenous zones (e.g., through mechanical and/or electromagnetic mechanisms). Use of sex toys can provide a user with various psychological and physiological benefits, and in many cases, can promote healthy relationships with others.

SUMMARY

In an aspect, a sexual stimulation device includes a drive module, a stimulating element, a fulcrum, and a compliant member. The stimulating element has a first end coupled to the drive module in a manner such that the first end of the stimulating element moves along a first path when the drive module is operated. The stimulating element also has a second end opposite the first end. The fulcrum is disposed at a first point along an extension of the stimulating element such that the stimulating element pivots about the first point and the second end of the stimulating element translates according to a second path. The compliant member is coupled to the second end of the stimulating element.

Implementations of this aspect can include one or more of the following features.

In some implementations, the first path and second path both can be substantially circular.

In some implementations, the first path can be substantially circular and the second path is substantially elliptical.

In some implementations, the first path can be substantially circular and the second path can be substantially linear.

In some implementations, the compliant member can include a sheath.

In some implementations, the compliant member can include a housing.

In some implementations, the second path can have has a radius of approximately 1.5 mm.

In some implementations, the second end of the stimulating element can move along the second path at a frequency of approximately 7000 Hz.

In some implementations, the fulcrum can define an aperture, and the stimulating element can extend through the aperture of the fulcrum.

In some implementations, a distance between the first point and the first end of the stimulating element can be approximately equal to a distance between the first point and the second end of the stimulating element.

In some implementations, a distance between the first point and the first end of the stimulating element can be shorter than a distance between the first point and the second end of the stimulating element. In some implementations, a distance between the first point and the first end of the stimulating element can be longer than a distance between the first point and the second end of the stimulating element.

In some implementations, the stimulating element can include a rod extending primarily in a single dimension.

In some implementations, the stimulating element can include a rod having one or more bends.

In some implementations, the sexual stimulation device can further include a coupling element, where the coupling element is coupled to the drive module along a rotational axis of the drive module, and where the coupling element is coupled to the first end of the stimulating element at a second point off-set from the rotational axis of the drive module.

In some implementations, the stimulating element can have a diameter of approximately 2 mm or greater.

In another aspect, the present disclosure provides a sexual stimulation device comprising: a drive module comprising one or more motors; a coupling element coupled to the drive module along a rotational axis of the drive module, the coupling element further comprising a mounting point that is off-set from the rotational axis of the drive module; a stimulating element comprising: a first end coupled to the mounting point of the coupling element in a manner such that the first end of the stimulating element moves along a first path when the drive module is operated; and, a second end opposite the first end; a fulcrum disposed at a first point along an extension of the stimulating element such that the stimulating element pivots about the first point and the second end of the stimulating element translates according to a second path; and a compliant member coupled to the second end of the stimulating element.

The details of one or more embodiments are set forth in the accompanying drawings and the description below. Other features and advantages will be apparent from the description and drawings, and from the claims.

DETAILED DESCRIPTION

Various different types of sexual stimulation devices are described herein. In some cases, a user can operate the sexual stimulation device to stimulate one or more erogenous zones of her body in order to derive sexual pleasure (e.g., as a part of a masturbatory activity). In some cases, a user can operate the sexual stimulation device to provide sexual pleasure for others (e.g., as a part of a shared sexual activity). While some implementations of the device are described herein as being used by and/or for a female, nothing in this description should be taken to limit applications of the device to female users.

Implementations of the sexual stimulation device can provide various benefits. For example, in some cases, the sexual stimulation device can allow a user to achieve an orgasm in a relatively short period of time (e.g., less than one minute). In some cases, the operation of the sexual stimulation device can be adjustable (e.g., by a user or a manufacturer), and can be adjusted to suit the needs of several different users or several different types of users. In some cases, the sexual stimulation device can be portable, such that it can be readily transported between different locations.

Figure 1A:
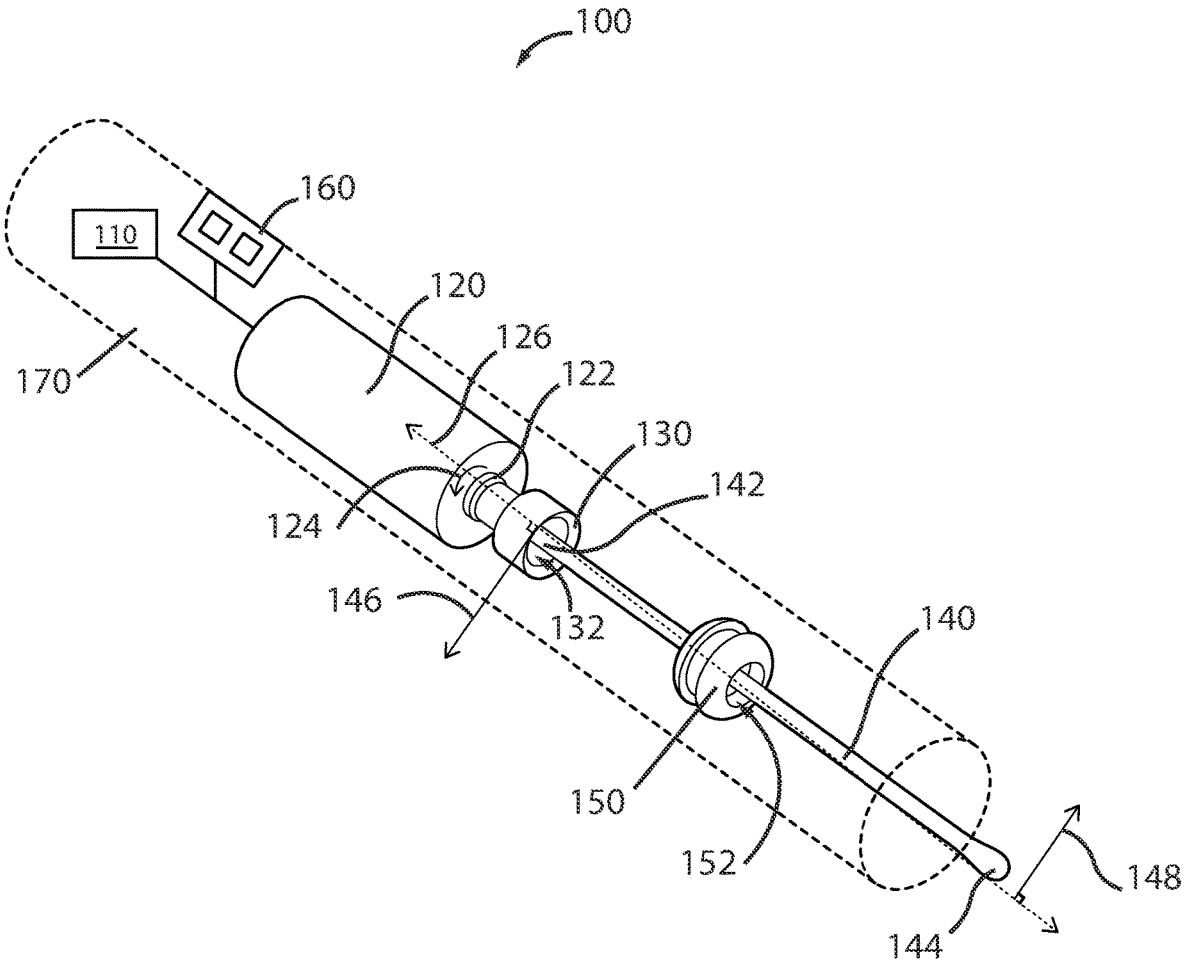
FIG. 1A is a diagram of an example sexual stimulation device.

A simplified diagram of an example sexual stimulation device 100 is shown in FIG. 1A. The sexual stimulation device 100 includes a power supply 110, a drive module 120, a coupling element 130, a stimulating element 140, a fulcrum 150, a control module 160, and a housing 170. In an example usage of the sexual stimulation device 100, a user grasps the housing 170 and activates the drive module 120 (e.g., by inputting commands through the control module 160). When activated, the drive module 120 displaces the stimulating element 140 in a continuous or periodic manner, resulting in a vibration of the stimulating element 140. The user then presses a portion of the stimulating element 140 against an erogenous zone of her body (e.g., against her clitoris or her urethra) in order to facilitate sexual stimulation.

The power supply 110 provides electric energy to the sexual stimulation device 100. In the example shown in FIG. 1A, the power supply 110 is electrically coupled to drive module 120 and the control module 160 (e.g., through a conductive wire or trace) in order to provide each of these components with sufficient electric energy to operate. In practice, however, the power supply 110 need not be electrically coupled to both. For example, in some cases, the control module 160 might not require electric energy to operate, and the power supply 110 can be electrically coupled to only the drive module 120.

The power supply 110 can provide electric energy in a variety of ways, depending on the implementation. For instance, in some cases, the power supply 110 can include an electric battery that converts stored chemical energy (e.g., energy contained within one or more electrochemical cells) into electrical energy. As examples, the power supply 110 can include one or more alkaline batteries, nickel-metal hydride batteries, lithium ion batteries, lithium polymer batteries, nickel cadmium batteries, or any other type of battery.

In some cases, the power supply 110 can provide electric energy, at least in part, by obtaining electric energy from an outside source. For instance, in some cases, the power supply 110 can be coupled to an external electric source (e.g., a household electrical system, external generator, or other external power source) and convert electrical energy obtained from the external electric source for use by the sexual stimulation device 100. As an example, the power supply 110 can include one or more voltage converters (e.g., direct current (DC) convertors, alternating current (AC) converters, AD-to-DC converters, or DC-to-AC converters) in order to provide electrical energy at a voltage, current, and frequency that can be readily used by the other components of the sexual stimulation device 100.

In some cases, the power supply 110 can include modules to recharge one or more of the batteries contained within the sexual stimulation device 100. For example, in some cases, the power supply 110 can include a connection port that allows a user to connect a conductive cable coupled to an external source of electric energy. Electric energy received from this external source can then be used to recharge the batteries.

As another example, in some cases, the power supply 110 can include an inductive charging elements that allows a user to place the sexual stimulation device 100 in proximity with an inductive power transmitter. Electric energy received from this inductive power transmitter can then be used to recharge the batteries. For example, the power supply 110 can include electrically conductive coils positioned within the sexual stimulation device (e.g., wrapped around a battery of the power supply 110 and/or positioned at an end of the sexual stimulation device 100). The inductive power transmitter can include corresponding coils configured to electrically interface with the coils of the power supply 110 (e.g., configured to insert into the coils of the power supply 110, insert around the coils of the power supply 110, or position above or below the coils of the power supply 110). The user can recharge the sexual stimulation device 100 by coupling the sexual stimulation device 100 to the inductive power transmitter to inductively charge the power supply 110, then remove the sexual stimulation device 100 after charging.

The drive module 120 converts electric energy into mechanical energy (e.g., movement). As an example, the drive module 120 can include one or more electric motors. When electric energy (e.g., from the power supply 110) is applied to the drive module 120, the drive module 120 applies a force to a drive element 122 (e.g., a drive shaft), such that the drive element 122 is rotated in a circular direction 124 about rotational axis 126. In some cases, the drive module 120 can generate force in a continuous manner. For example, in some implementations, when the drive module 120 is active, the drive module 120 can continuously rotate the drive element 122. In some cases, the drive module 120 can generate force in a periodic manner. For example, in some implementations, when the drive module 120 is active, the drive module 120 can periodically rotate the drive element 122 according to a particular pattern (e.g., according to a particular angular velocity, duty cycle, and waveform). In some cases, the drive module 120 can generate force according to other patterns (e.g., according to a particular pulse rate), or in some cases, irregularly without a particular pattern (e.g., randomly). In some cases, the operation of the drive module 120 can be controlled by the user (e.g., selectively turned on and off, or selectively switched between different patterns of operation).

The drive module 120 is coupled to stimulating element 140 through the coupling element 130, such that movement of the drive module 120 results in a corresponding movement of the stimulating element 140. In the example shown in FIG. 1A, the coupling element 130 is physically connected to both the drive element 122 of the drive module 120 and the stimulating element 140, such that movement of the drive element 122 results in corresponding movement of the stimulating element 140. In some cases, the coupling element 130 can convert one type of movement by the drive module 120 into a different type of movement by the stimulating element 140. For instance, in the example shown in FIG. 1A, an end 142 of the stimulating element 140 is linked to the coupling element 130 at a mounting point 132 offset from the rotational axis 126 of the drive element 122 (e.g., an off-center mount or hole on the coupling element 130). Thus, rotation of the drive element 122 causes the stimulating element 140 to undergo periodic motion (e.g., a circular motion about the rotational axis 126).

Figure 1B:
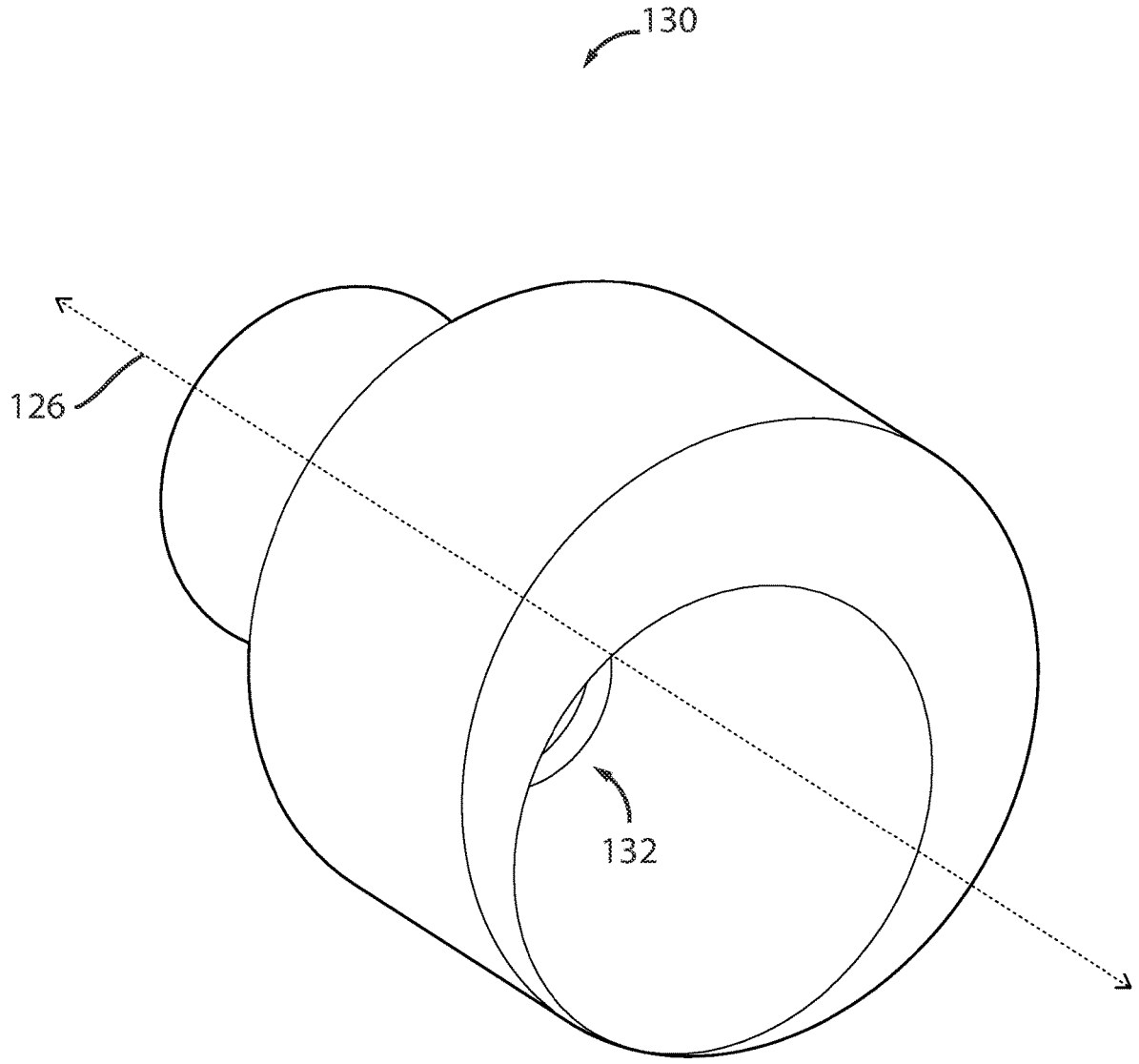
FIG. 1B is a diagram of a coupling element of the sexual stimulation device of FIG. 1A.

The coupling element 130 shown in FIG. 1A is shown in greater detail in FIG. 1B. As shown in FIG. 1B, the coupling element 130 includes a mounting point 132 offset from the center of the coupling element 130. Thus, when the coupling element 130 is rotated about the rotational axis 126, the mounting point 132 will traverse a circular path (or a substantially circular path) about the rotational axis 126. Likewise, when the end 142 of the stimulating element 140 is coupled to the coupling element 130 at the mounting point 132, the end 142 will also traverse a circular path (or a substantially circular path) about the rotational axis 126.

The coupling element 130 is dimensioned such that the stimulating element 140 can be securely coupled to the coupling element 130 at the mounting point 132. In some cases, the mounting point 132 includes an aperture that accepts the insertion of the stimulating element 140. The stimulating element 140 can be secured within this aperture (e.g., using an adhesive, a screw, a pin, a latch, or any other suitable mechanism). In some cases, although the stimulating element 140 is secured to the coupling element 130, the stimulating element 140 can freely rotate with respect to the coupling element 130. This can be useful, for example, as it allows the coupling element 130 to rotate in order to translate the stimulating element 140 about a circular path, while not requiring that the stimulating element 140 itself rotate along with the coupling element 130.

The stimulating element 140 is coupled to the coupling element 130 and is displaced by movement of the drive module 120. While the stimulating element 140 is moved by the drive module 120, a user can press the stimulating element 140 against her body in order to provide physical stimulation to the contacted region. For example, in some cases, the user can press the end 144 of the stimulating element 140 against an erogenous zone, such that the periodic motion of the end 144 provides physical stimulation. As another example, in some cases, the user can press a portion of the stimulating element 140 between the ends 142 and 144 against an erogenous zone.

The dimensions of the stimulating element 140 can vary, depending on the application. For example, in some cases, the stimulating element 140 can have a diameter of approximately 2 mm. In other cases, the stimulating element 140 can have a diameter greater than 2 mm (e.g., approximately 3 mm, 4 mm, 5 mm, 6 mm, 7 mm, and so forth). In other cases, the stimulating element 140 can have a diameter less than 2 mm (e.g., approximately 1.5 mm, 1 mm, 0.5 mm, and so forth). A stimulating element having a larger diameter can be beneficial in some cases, as the relatively larger diameter may improve the device's effectiveness in providing sexual stimulation for some users (e.g., due to an increase in surface area of the stimulating element), and/or may be more aesthetically pleasing to some users. A stimulating element having a smaller diameter can be beneficial in some cases, as the relatively smaller diameter may reduce the vibration and/or noise generated by the sexual stimulating device during use, and thus may be more comfortable or more discreet for the user. Thus, the diameter of the stimulating element 140 can be varied to balance at least these two consideration. Further in some cases, the dimensions of the ends of the stimulating element 140 can differ from the rest of the stimulating element 140. For example, in some implementations, the end 144 can be enlarged relative to the other portions of the stimulating element 140. The end 144 can have, for instance, a tear-drop, spherical, or other shape. The diameter of the end 144 can be, for example, between approximately 2 mm and 5 mm. Other diameters are also possible, depending on the implementation.

The fulcrum 150 defines an aperture 152, and is positioned about the stimulating element 140 along the rotational axis 126. The fulcrum 150 dictates the degree to which the stimulating element 140 moves in response to movement of the drive module 120. For example, when the end 142 of the stimulating element 140 is offset from the rotational axis 126 in a direction 146 orthogonal to the rotational axis 126, the fulcrum 150 causes the stimulating element 140 to pivot at their point of contact. As a result, the opposite end 144 is displaced in the opposite direction 148 orthogonal to the rotational axis 126. Thus, as the end 142 of the stimulating element 140 traverses a circular path about the rotational axis 126, the end 144 likewise traverses a circular path about the rotational axis 126.

Figure 1C:
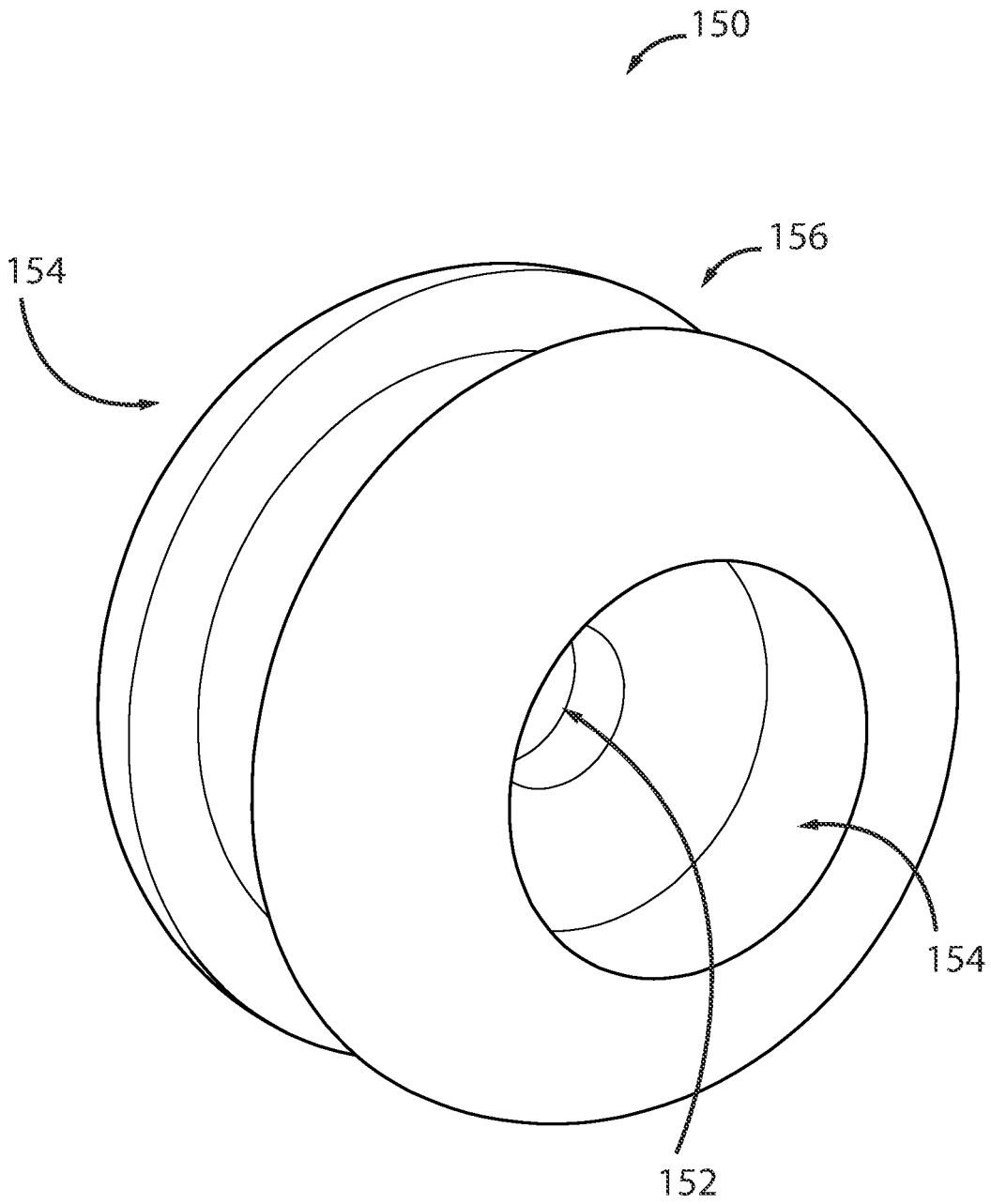
FIG. 1C is a diagram of a fulcrum of the sexual stimulation device of FIG. 1A.

The fulcrum 150 shown in FIG. 1A is shown in greater detail in FIG. 1C. As shown in FIG. 1C, the fulcrum 150 defines an aperture 152 through the center of the fulcrum 150. The aperture 152 is dimensioned such that the stimulating element 140 can be inserted through the aperture 152, and thus, through the fulcrum 150. The fulcrum 150 also includes two notches 154 along the front and rear of the fulcrum 150. The notches 154 are each positioned surrounding the aperture 152, and have a diameter larger than that of the aperture 152, thus allowing the stimulating element 140 to pivot about the fulcrum 150. The fulcrum 150 also includes a groove 156. The groove 156 can, in some cases, provide a mounting point for the fulcrum 150, such that the fulcrum can be securely fixed to the housing 170. In some cases, the fulcrum is composed of a material (e.g., a polymer, a silicone, or a thermoplastic material) that is sufficiently hard to efficiently transfer energy from the drive module 120 to the stimulating element 140 and resist wear, while sufficiently soft or elastic to reduce noise and damping under load.

In some cases, the drive module 120, the coupling element 130, the stimulating element 140, and the fulcrum 150 can be arranged to reduce the amount of vibration and/or sound that is generated during operation. For example, in some cases, the drive module 120 can be coupled to the coupling element 130, the stimulating element 140, and the fulcrum 150 such that the load placed upon the drive module 120 is substantially balanced (e.g., such that drive module 120 does not experience substantial off-center loads along its axis of rotation during operation). As a result, the drive module 120 can operate more stably and/or more quietly. This can be beneficial, as it allows a user to operate the sexual stimulating device 100 more stably and/or discreetly.

The control module 160 controls the operation of the sexual stimulation device 100. In some implementations, the control module 160 allows the user to input commands in order to control the operation of the sexual stimulation device 100. As an example, in some cases, the user can input commands to switch the sexual stimulation device 100 on or off, adjust the speed of operation of the drive module 120, or adjust a pattern of movement by the drive module 120. In some implementations, the control module 160 can include one or more input elements such as buttons, switches, dials, knobs, levers, touch sensitive elements (e.g., resistive or capacitive touch sensors) that allow the user to select between several different commands. In some cases, the control module 160 includes separate input elements (e.g., separate buttons) for each individual command. In some cases, the user can repeatedly press a single button to switch the sexual stimulation device 100 between multiple different operating states. As an example, in some implementations, a user can press a button to switch the device from a power off state to a low operating state (e.g., a state in which the drive module 120 rotates drive element 122 relatively slowly). The user can press the button again to switch the device to a medium operating state (e.g., a state in which the drive module 120 rotates drive element 122 more quickly), press the button again to switch the device to a high operating state (e.g., a state in which the drive module 120 rotates drive element 122 more quickly still), and press the button again to switch the device back to the power off state. In some cases, in response to an inputted command, the control module 160 interprets the command, and directly adjusts the operation of the appropriate component of the sexual stimulation device 100. For example, in some cases, the user can input commands to switch the sexual stimulation device 100 on or off, adjust the speed of operation of the drive module 120, or adjust a pattern of movement by the drive module 120; in response, the control module 160 adjusts the operation of the drive module 120 (e.g., by regulating the electrical power that is delivered from the power supply 110 to the drive module 120 in a particular manner so as to achieve the desired operation).

In some cases, in response to an inputted command, the control module 160 does not directly adjust the operation of the components of the sexual stimulation device 100, and instead relays the inputted commands to the appropriate component. For example, in some cases, when the user inputs a command to adjust a pattern of movement by the drive module 120, the control module 160 can transmit that inputted command to the drive module 120 for execution by the drive module 120.

The control module 160 can also present information of the user regarding the operational status of the sexual stimulation device 100 (e.g., whether the sexual stimulation device 100 is on or off, the power state of the sexual stimulation device 100, the speed at which the drive module 120 is operating, the pattern according to which the drive module 120 is operating, and so forth). In some cases, the control module 160 can include one or more indicator lights (e.g., light emitting diodes, LEDs) or display screens that visually present this information to a user.

The housing 170 provides support and protection for the other components of the sexual stimulation device 100. In the example shown in FIG. 1A, the power supply 110, the drive module 120, the fulcrum 150, and the control module 160 are secured to the housing 170, such that they cannot move with respect to one another during operation of the sexual stimulation device 100. The housing 170 can be made of a single materials or a combination of multiple different materials. For example, in some cases, the housing 170 can be made of plastic, metal, rubber, wood, ceramic, glass, silicon, or combinations thereof.

In some cases, the housing 170 can partially enclose the other components of the sexual stimulation device 100, such that some of the components are either fully or partially exposed. For example, in some implementations, the housing 170 can leave the end 144 of the stimulating element 140 fully or partially exposed, such that the end 144 can directly contact a user's body.

In some cases, however, the housing 170 can fully or substantially fully enclose the other components of the sexual stimulation device 100, such that each of the components is contained within the housing 170. For example, in some cases, the housing can include a compliant member that encloses the end 144. A compliant member can include, for instance, a sheath made of a soft or compliant material, a coating or layer applied over the stimulating element 140, (e.g., one or more layers of paints or molded materials such as silicon), a skirt that surrounds part or all of the stimulating element 140, or combinations thereof. Thus, in some cases, the stimulating element 140 need not directly contact a user's body during use of the sexual stimulation device. Instead, movement of the stimulating element 140 causes a corresponding movement of the housing (e.g., a movement of the compliant member). Accordingly, the user can press a portion of the housing along the stimulating element 140 (e.g., the compliant member) against her body in order to obtain sexual stimulation. In some cases, the compliant member can be integrally formed with other portions of the housing. In other cases, the compliant member can be separate component than the other portions of the housing. In some cases, the user can remove the compliant member from the device in order to clean and/or replace the compliant member independent of the other portions of the housing.

Figure 1D:
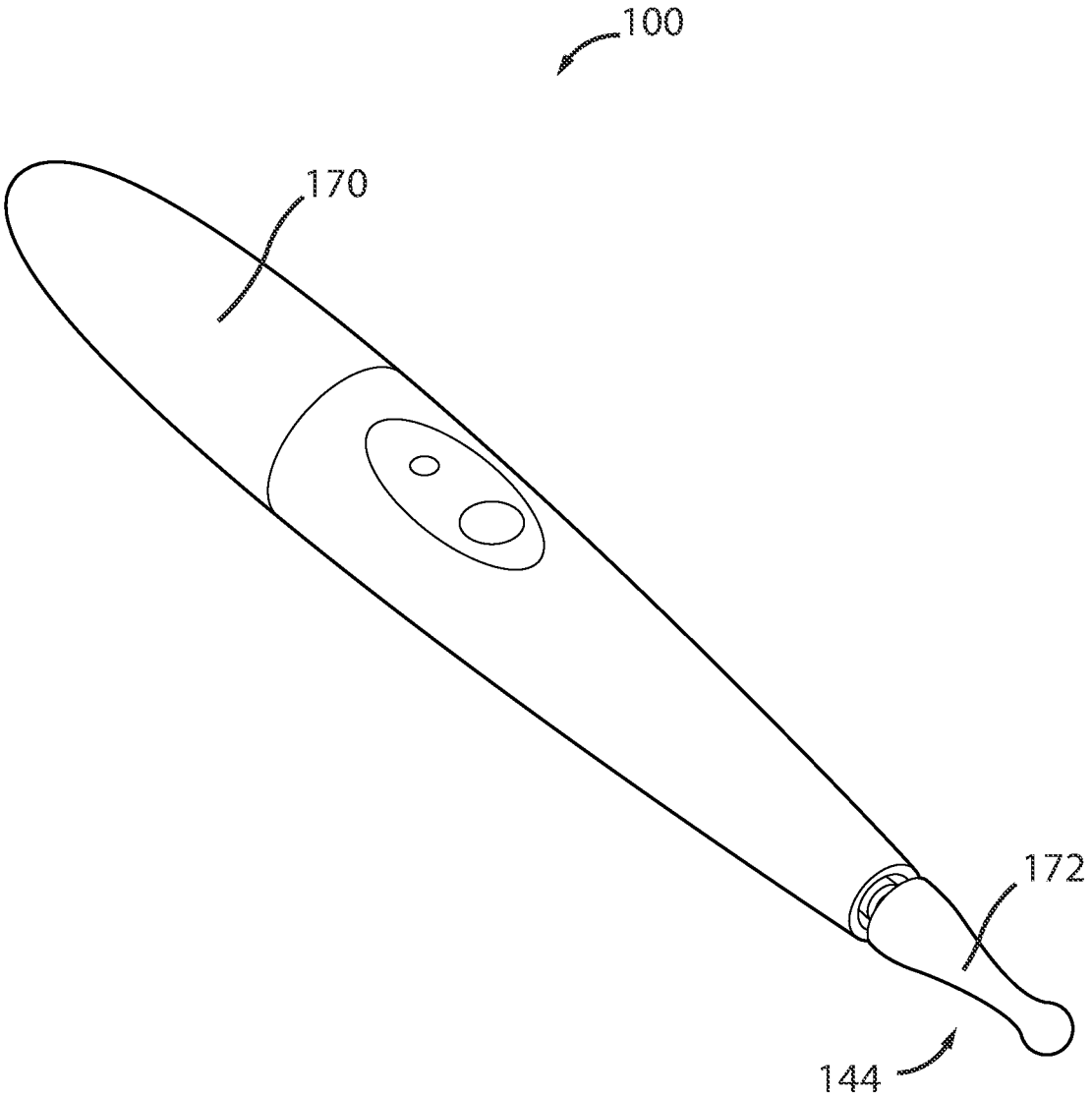
FIG. 1D is a diagram of a sexual stimulation device of FIG. 1A having a housing with a sheath.
Figure 1E:
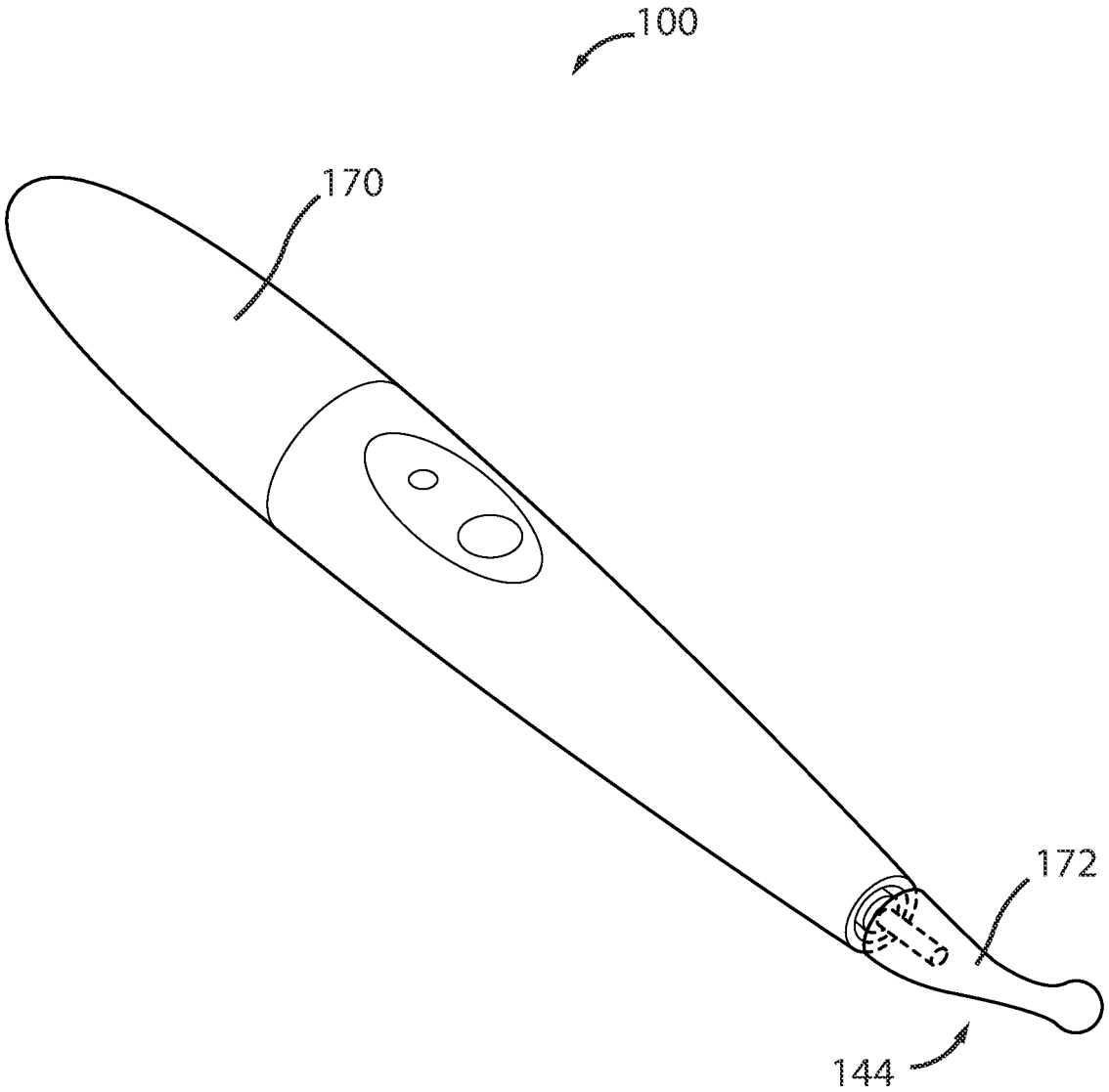
FIG. 1E is a diagram of a sexual stimulation device of FIG. 1A having a housing with a curved sheath.

As an example, a sexual stimulation device 100 is shown in FIG. 1D. In this example, the components of the device are enclosed by a housing 170 (including a compliant sheath 172 enclosing the end 144 of the stimulating element 140). As another example, a sexual stimulation device 100 is shown in FIG. 1E having a curved sheath 174. Although example housings 170 and sheaths are shown and described, these are merely illustrative examples. In practice, housings having other arrangements are also possible, depending on the implementation.

Figure 2A:
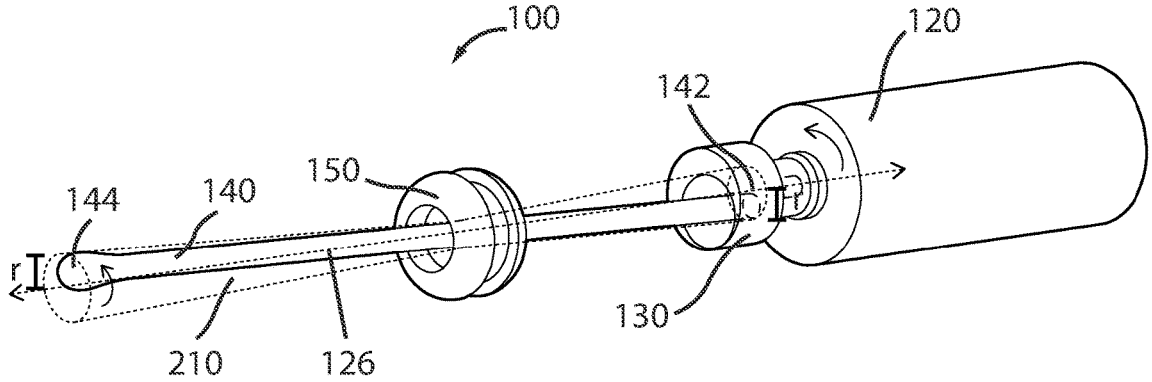
FIGS. 2A-C are diagrams of example sexual stimulation devices with fulcrums disposed at different positions relative to the stimulating elements of the respective sexual stimulation devices.

In some cases, the position of the fulcrum 150 can be adjusted along the extension of the stimulating element 140, such that end 144 is moves differently in response to movement of the end 142. For example, FIG. 2A shows an example sexual stimulation device 100 (for illustrative purposes, only the drive module 120, the coupling element 130, the stimulating element 140, and the fulcrum 150 are shown). The end 142 of the stimulating element 140 is offset by a radius r from the rotational axis 126. In this example, the fulcrum 150 is positioned at the center of the stimulating element 140. Thus, when the coupling element 130 traverses a circular path about the rotational axis 126, this causes the end 142 to also transverse a circular path having a radius r. The range of motion of the stimulating element 140 is illustrated as cones 210.

Figure 2B:
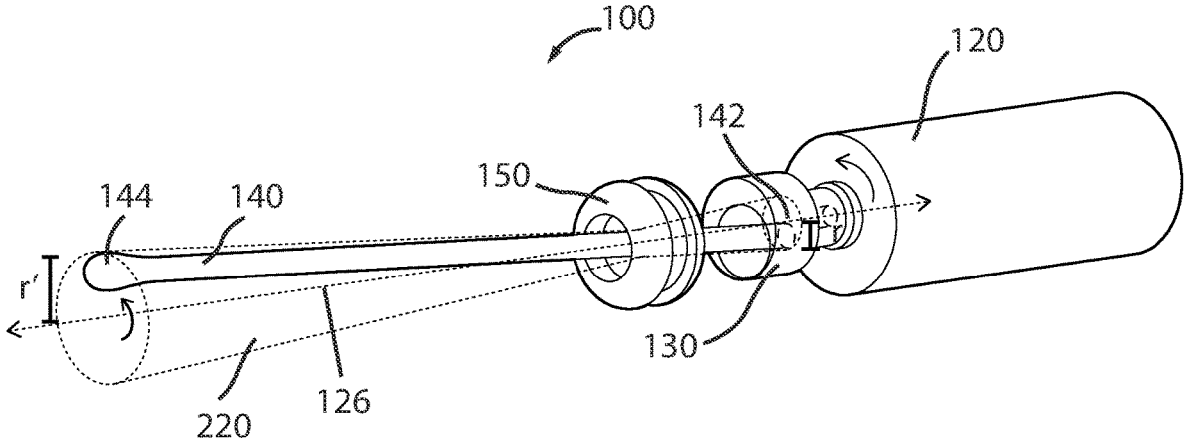

However, referring to FIG. 2B, if the fulcrum 150 is positioned at a point closer to the end 142 of the stimulating element 140, the stimulating element 140 will pivot at a point closer to the end 142. Thus, when the end 142 of the stimulating element 140 traverses a circular path having a radius r, the end 144 traverses a circular path having a radius r' greater than r. The range of motion of the stimulating element 140 is illustrated as cones 220.

Figure 2C:
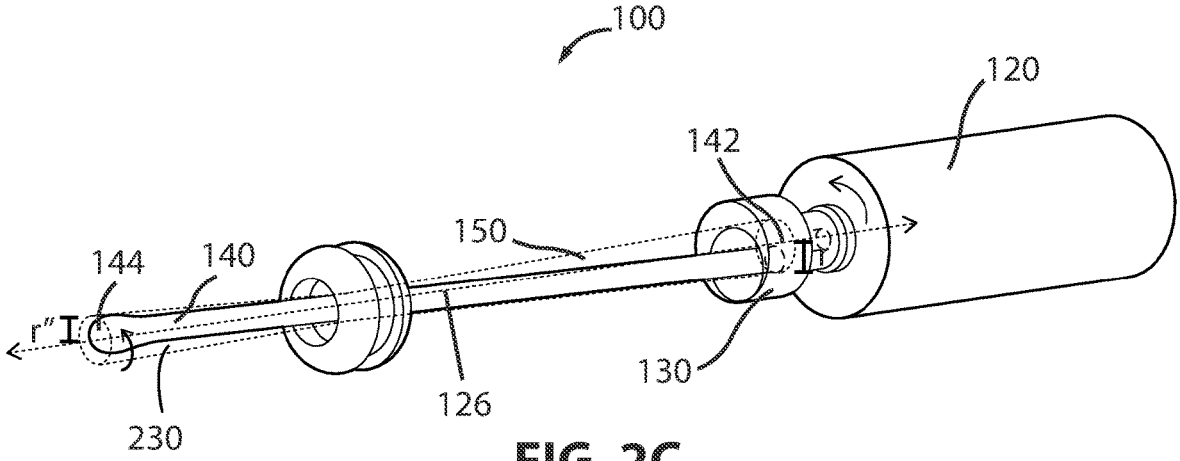

Conversely, referring to FIG. 2C, if the fulcrum 150 is positioned at a point closer to the end 144 of the stimulating element 140, the stimulating element 140 will pivot at a point closer to the end 144. Thus, when the end 142 of the stimulating element 140 traverses a circular path having a radius r, the end 144 traverses a circular path having a radius r" less than r. The range of motion of the stimulating element 140 is illustrated as cones 230.

In some cases, the fulcrum 150 can be positioned at a point along stimulating element 140 such that the end 144 of the stimulating element 140 traverses a circular path having a specific radius in response to movement of the end 142. In some cases, the position of the fulcrum 150 can be changed, such that the end 144 traverses a circular path having a greater or lesser radius in response to movement of the end 142. In some cases, the position of the fulcrum 150 can be adjusted by a user such that this degree of movement can be specified by the user. For example, in some cases, the fulcrum can be slideably secured to the housing (e.g., positioned along a sliding track within the housing), such that it can slide along the length of the stimulating element 140. As another example, in some cases, the fulcrum can be secured via screw threads that encircle the stimulating element, such that rotating the fulcrum within the screw threads causes the fulcrum to translate along the length of the stimulating element 140. In some cases, the position of the fulcrum 150 can be adjusted by a manufacturer (e.g., during construction of the sexual stimulation device 100) such that this degree movement can be specified by the manufacturer.

In some cases, the size of the aperture 152 (e.g., the diameter) also can be adjusted such that end 144 moves differently in response to movement of the end 142. For example, if the aperture 152 has a diameter that is substantially similar to the outer diameter of the stimulating element 140 (e.g., such that the stimulating element 140 is flush or nearly flush against the fulcrum 150), movement of the end 142 will result in a relatively greater degree of movement of the end 144. However, if the aperture 152 has a diameter that is larger than the outer diameter of the stimulating element 140 (e.g., such that the stimulating element 140 is relatively loose within the fulcrum 150), movement of the end 142 will result in a relatively lesser degree of movement of the end 144. Thus, the aperture 152 can also be adjusted in order to obtain a desired pattern of movement of the end 144. In some cases, the size of the aperture 152 can be substantially similar to the outer diameter of the stimulating element 140, such that a seal is formed between them. This can be beneficial in some cases, as it can prevent or otherwise reduce the introduction of contaminants (e.g., dirt, dust, and liquids) into the sexual stimulating device.

In some cases, the sexual stimulation device 100 can move the stimulating element 140 in a particular way in order to achieve a particular beneficial effect. For example, in some implementations, the sexual stimulation device can be configured such that during operation, the end 144 of the stimulating element 140 traverses a circular path having a radius of approximately 1.5 mm (e.g., a diameter of between 1 mm to 2 mm), at a frequency of approximately 7 kHz (e.g., between 6.5 kHz to 8 kHz), and at a 100% duty cycle. Other radii (e.g., approximately 0.5 mm, 1 mm, 2 mm, 2.5 mm or other radius), frequencies (e.g., approximately 1 kHz, 3 kHz, 5 kHz, 9 kHz, or other frequency), and/or duty cycles (e.g., less than 1% to less than 100%) can alternatively be used. In some cases, when the user presses the 144 against an erogenous zone of the body (e.g., the clitoris or the urethra), the user can achieve an orgasm in a relatively short period of time (e.g., a minute or less).

Although an example movement of the end 144 is described, this is merely one example. In practice, the stimulating element 140 might move different during operation of the sexual stimulation device 100, depending on the implementation.

Although a sexual stimulation device 100 is shown in FIG. 1A, this is merely an illustrative example. In practice, a sexual stimulation device can have different arrangements of components, as well as additional components or fewer components, depending on the implementation.

Figure 3:
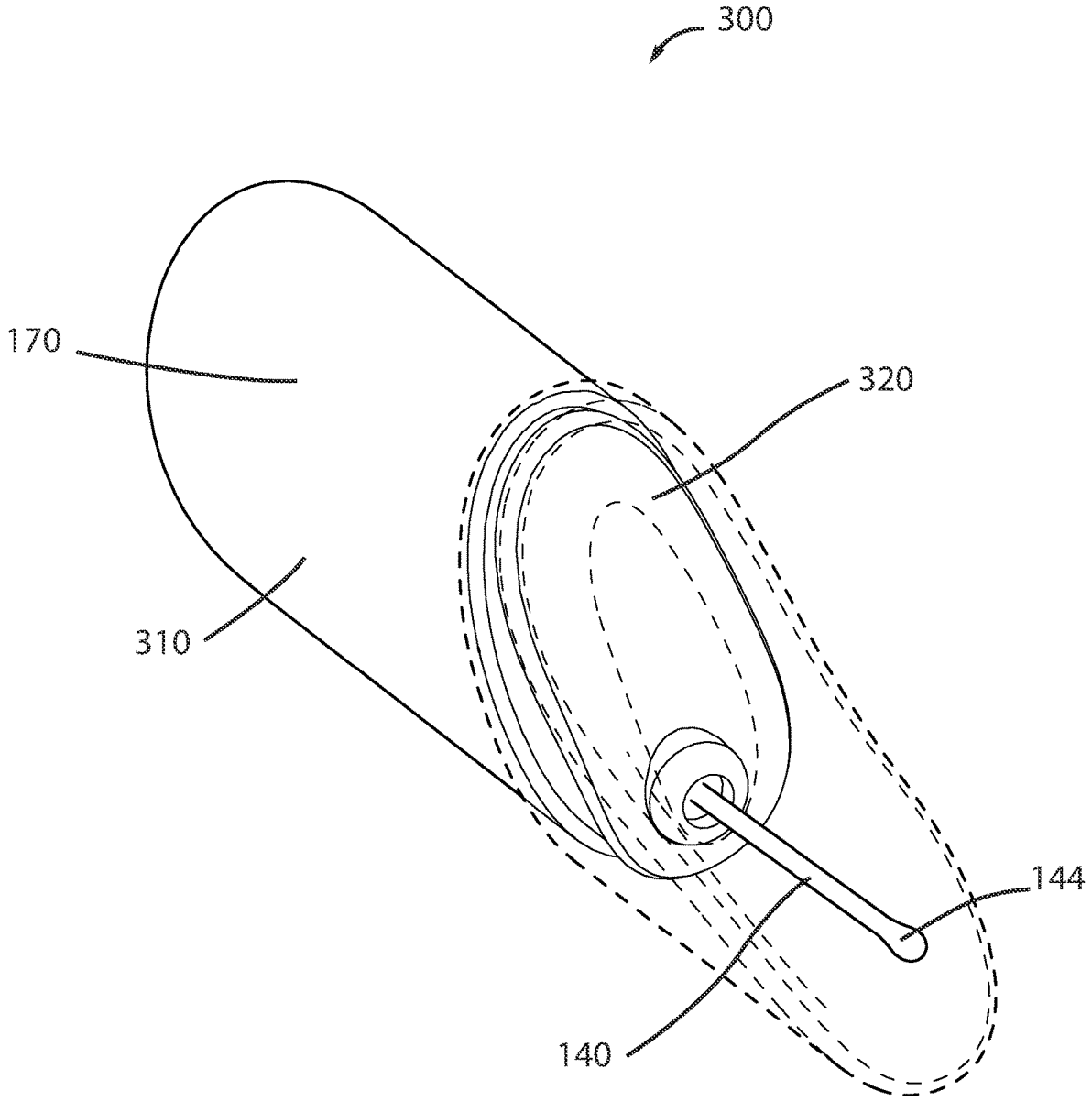
FIG. 3 is a diagram of another example sexual stimulation device.

For example, another example sexual stimulation device 300 is shown in FIG. 3. In this example, the sexual stimulation device 300 includes a housing 170 having a first portion 310 and a second portion 320. When the first portion 310 and the second portion 320 are coupled to each other, the housing 170 fully encloses several of the components of the sexual stimulation device 300 (e.g., the power supply 110, the drive module 120, the coupling element 130, and the fulcrum 150), but only partially encloses the stimulating element 140. As the end 144 of the stimulating element 140 is exposed and not enclosed by the housing 170, the user can directly place the end 144 against her body. The first portion 310 and the second portion 320 can be separated from each other in order to expose components contained within the housing 170. This can be beneficial, for example, in facilitating cleaning and servicing of the sexual stimulation device 300. In some cases, the first portion 310 and the second portion 320 can be made of different materials. For as example, the first portion 310 can be made of a relatively firmer material (e.g., a firm plastic), while the second portion 320 can be made of a relatively more compliant material (e.g., silicon or rubber). This can be beneficial, for example, as it allows a user to securely grasp the sexual stimulation device 300 along the first portion 310, while providing a more ergonomic second portion 320 when the sexual stimulation device 300 is in use.

Figure 4:
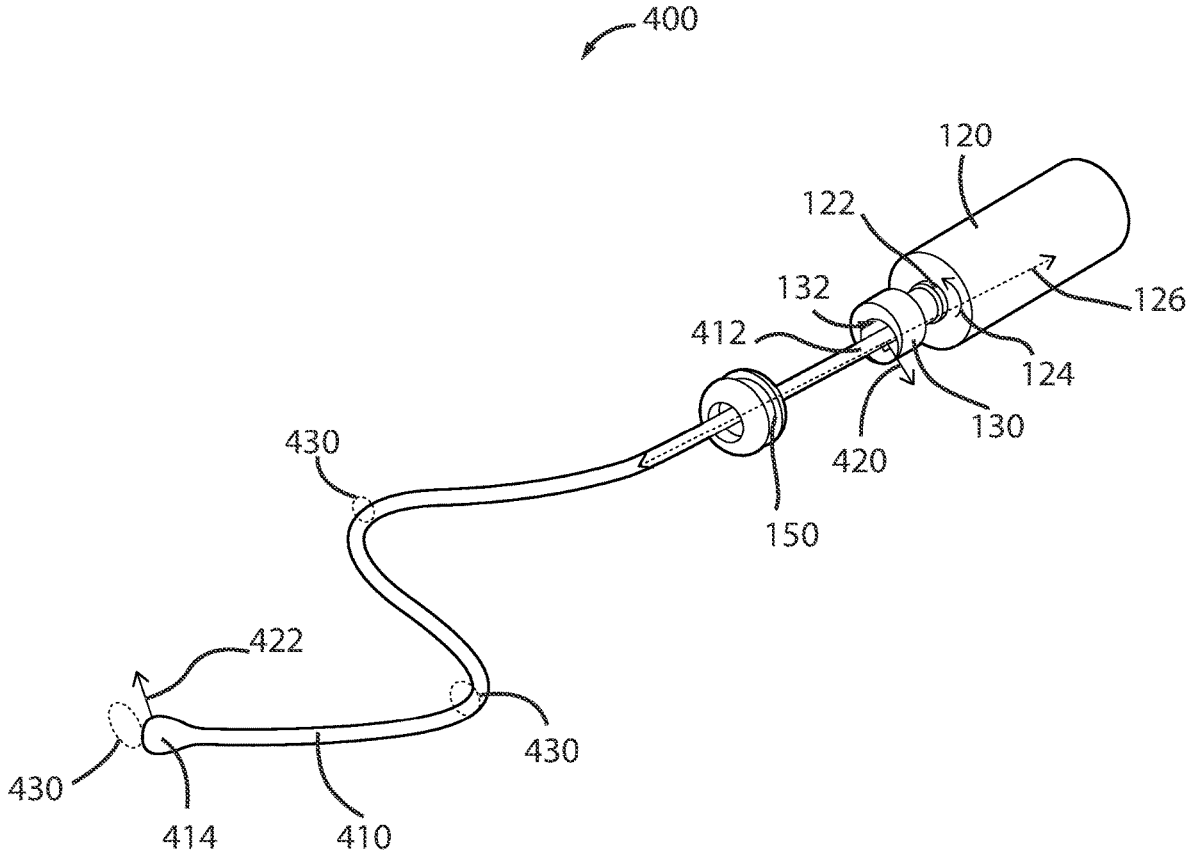
FIG. 4 is a diagram of another example sexual stimulation device.

Although the foregoing examples show a stimulating element 140 that is substantially straight, in practice, this need not be the case. For instance, another example sexual stimulation device 400 is shown in FIG. 4. For illustrative purposes, only a drive module 120, a coupling element 130, a stimulating element 402, and the fulcrum 150 are shown.

In a similar manner as described with respect to FIG. 1A, the example sexual stimulation device 400 shown in FIG. 4 includes a drive module 120 that is coupled to a stimulating element 410 through the coupling element 130, such that movement of the drive module 120 results in a corresponding movement of the stimulating element 410. Likewise, an end 412 of the stimulating element 410 is linked to the coupling element 130 at a point 132 offset from the rotational axis 126 of the drive element 122 (e.g., an off-center mounting point or hole on the coupling element 130). Thus, rotation of the drive element 122 in a circular direction 124 about rotational axis 126 causes the stimulating element 410 to undergo periodic motion.

In this example, the stimulating element 410 is not substantially straight, and instead bends at several places. However, in a similar manner as described with respect to FIG. 1A, the fulcrum 150 also dictates the degree to which the stimulating element 410 moves in response to movement of the drive module 120. For example, when the end 412 of the stimulating element 410 is offset from the rotational axis 126 in a direction 420, the fulcrum 150 causes the stimulating element 410 to pivot at their point of contact. As a result, the opposite end 414 is displaced in the opposite direction 422. Thus, as the end 412 of the stimulating element 140 traverses a circular path about the rotational axis 126, the end 414 likewise traverses a circular path. However, due to the bends in the stimulating element 410, the end 414 does not necessarily transverse a circular path about the rotational axis 126. The range of motion of the stimulating element 410 is illustrated as circles and ellipses 430. This can be beneficial, for example, as the bends in the stimulating element 410 cause different portions of the stimulating element 410 to move differently than other portions of the stimulating element (e.g., such that different portions of the stimulating element move along paths having different dimensions and/or shapes). Thus, the sexual stimulating device can provide different physical sensations to a user depending on which portion of the stimulating element 410 is pressed against the user's body. Bending the stimulating element 410 can also be beneficial for ergonomic purposes (e.g., by placing the stimulating element 410 in a position that is more comfortable to a user).

Figure 5A:
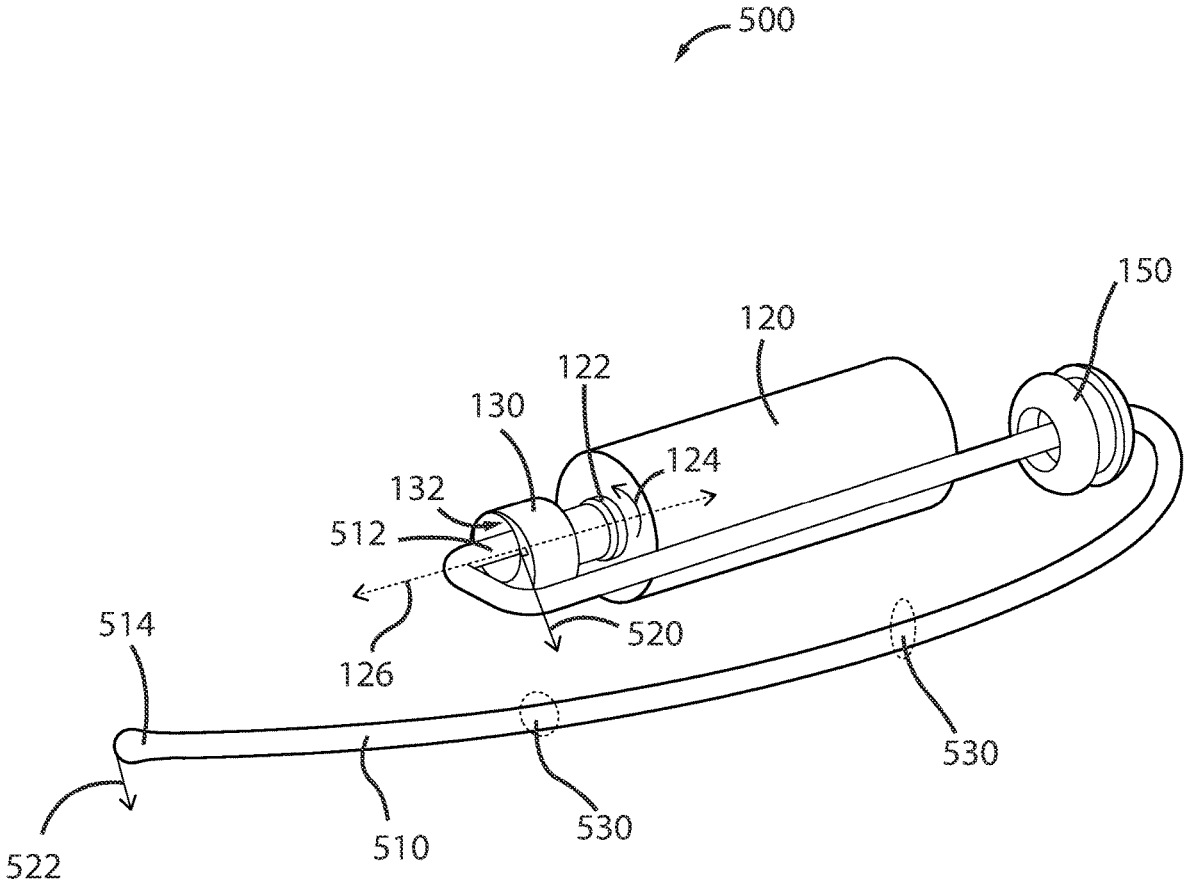
FIGS. 5A and 5B are diagrams of another example sexual stimulation device shown without and with a housing, respectively.
Figure 5B:
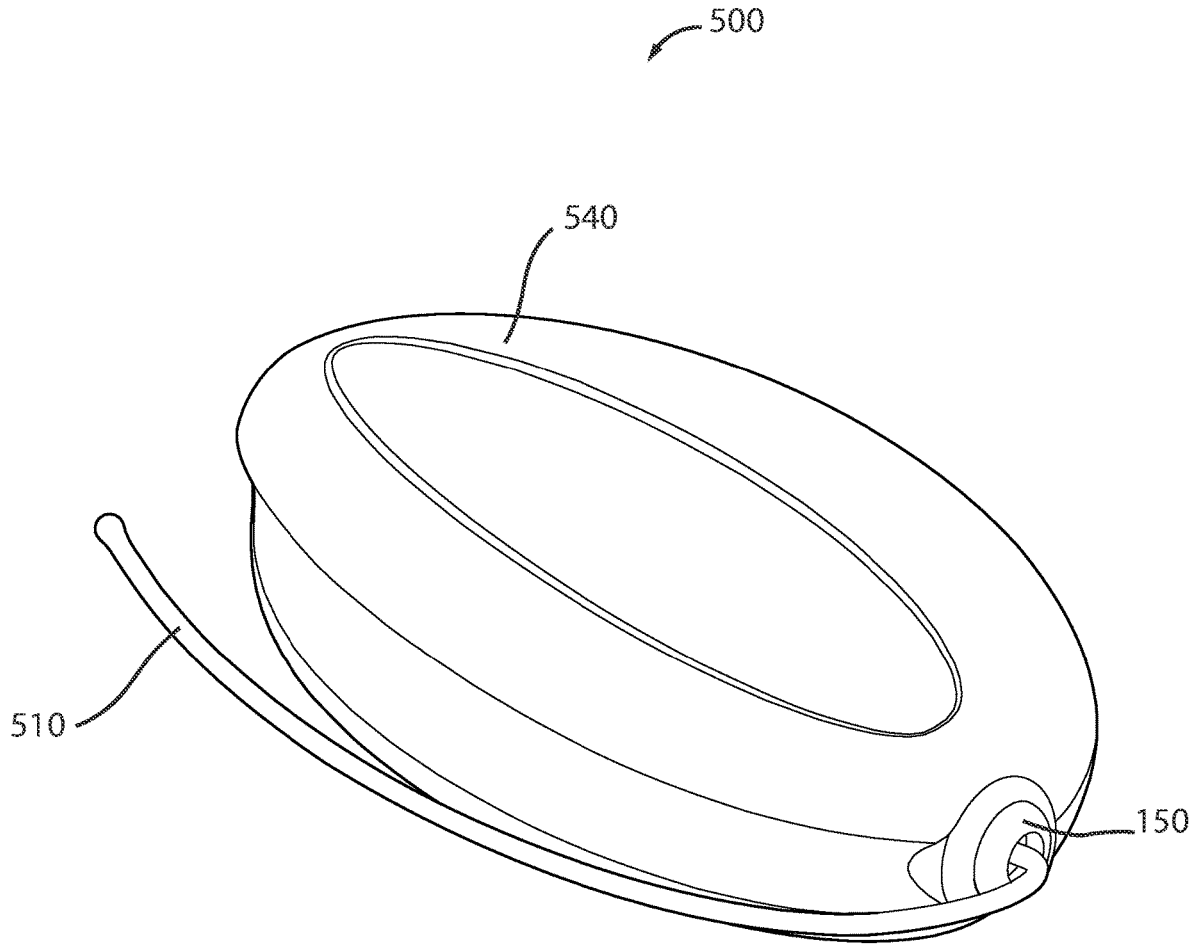

In a similar manner as described with respect to FIG. 1A, the position of the fulcrum 150 can be adjusted along the extension of stimulating element 410 and/or the size of the aperture can be varied, such that end 414 is rotated differently in response to rotation of the end 412. For example, the fulcrum 150 can be positioned closer to the end 412 of the stimulating element 140 in order to facilitate a greater degree of motion in the opposite end 414, or the fulcrum 150 can be positioned closer to the end 414 in order to facilitate a lesser degree of motion in the end 412. Likewise, the aperture 152 can be increased or decreased in diameter to facilitate a lesser or greater degree of motion in the end 414, respectively. Further still, the bends of the stimulating element 410 can also be adjusted (e.g., by bending the stimulating element 410 to a greater or lesser degree) in order to facilitate a lesser or greater degree of motion in the end 414, Another example sexual stimulation device 500 is shown in FIGS. 5A and 5B without and with a housing 540, respectively. For illustrative purposes, again, only a drive module 120, a coupling element 130, a stimulating element 510, and the fulcrum 150 are shown.

In a similar manner as described with respect to FIG. 1A, the example sexual stimulation device 500 shown in FIGS. 5A and 5B includes a drive module 120 that is coupled to a stimulating element 510 through the coupling element 130, such that movement of the drive module 120 results in a corresponding movement of the stimulating element 510. Likewise, the end 512 of the stimulating element 510 is linked to the coupling element 130 at a point 132 offset from the rotational axis 126 of the drive element 122 (e.g., an off-center mounting point or hole on the coupling element 130). Thus, rotation of the drive element 122 in a circular direction 124 about rotational axis 126 causes the stimulating element 510 to undergo periodic motion.

Again, in this example, the stimulating element 510 is not substantially straight, and instead bends at several places. However, in a similar manner as described with respect to FIG. 1A, the fulcrum 150 also dictates the degree to which the stimulating element 510 moves in response to movement of the drive module 120. For example, when the end 512 of the stimulating element 510 is offset from the rotational axis 126 in a direction 520, the fulcrum 150 causes the stimulating element 510 to pivot at their point of contact. As a result, the opposite end 514 is displaced in the direction 522. Thus, as the end 512 of the stimulating element 510 traverses a circular path about the rotational axis 126, the end 514 likewise traverses a circular path. However, due to the bends in the stimulating element 510, the end 514 does not necessarily transverse a circular path about the rotational axis 126. The range of motion of the stimulating element 510 is illustrated as ellipses 530. In a similar manner as above, this can be beneficial, for example, as the bends in the stimulating element 510 cause different portions of the stimulating element 510 to move differently than other portions of the stimulating element (e.g., such that different portions of the stimulating element move along paths having different dimensions and/or shapes). Thus, the sexual stimulating device can provide different physical sensations to a user depending on which portion of the stimulating element 510 is pressed against the user's body. Bending the stimulating element 510 can also be beneficial for ergonomic purposes (e.g., by placing the stimulating element 510 in a position that is more comfortable to a user). For example, as shown in FIG. 5, bending the stimulating element 510 results in a relatively long portion of the stimulating element 510 that can be readily pressed against the user's body.

In a similar manner as described with respect to FIG. 1A, the position of the fulcrum 150 can be adjusted along the extension of stimulating element 510 and/or the size of the aperture can be varied, such that end 514 is rotated differently in response to rotation of the end 512. For example, the fulcrum 150 can be positioned closer to the end 514 of the stimulating element 510 in order to facilitate a greater degree of motion in the opposite end 514, or the fulcrum 150 can be positioned closer to the end 514 in order to facilitate a lesser degree of motion in the end 514. Likewise, the aperture 152 can be increased or decreased in diameter to facilitate a lesser or greater degree of motion in the end 514, respectively. Further still, the bends of the stimulating element 510 can also be adjusted (e.g., by bending the stimulating element 510 to a greater or lesser degree) in order to facilitate a lesser or greater degree of motion in the end 514, The example sexual stimulation device 500 shown in FIG. 5A is shown with a housing 540 in FIG. 5B. Here, the housing 540 fully encloses several of the components of the sexual stimulation device 500 (e.g., the power supply 110, the drive module 120, and the coupling element 130), but only partially encloses the stimulating element 510 and the fulcrum 150. As the end 514 is exposed and not enclosed by the housing 540, the user can directly place the end 514 against her body.

Figure 6A:
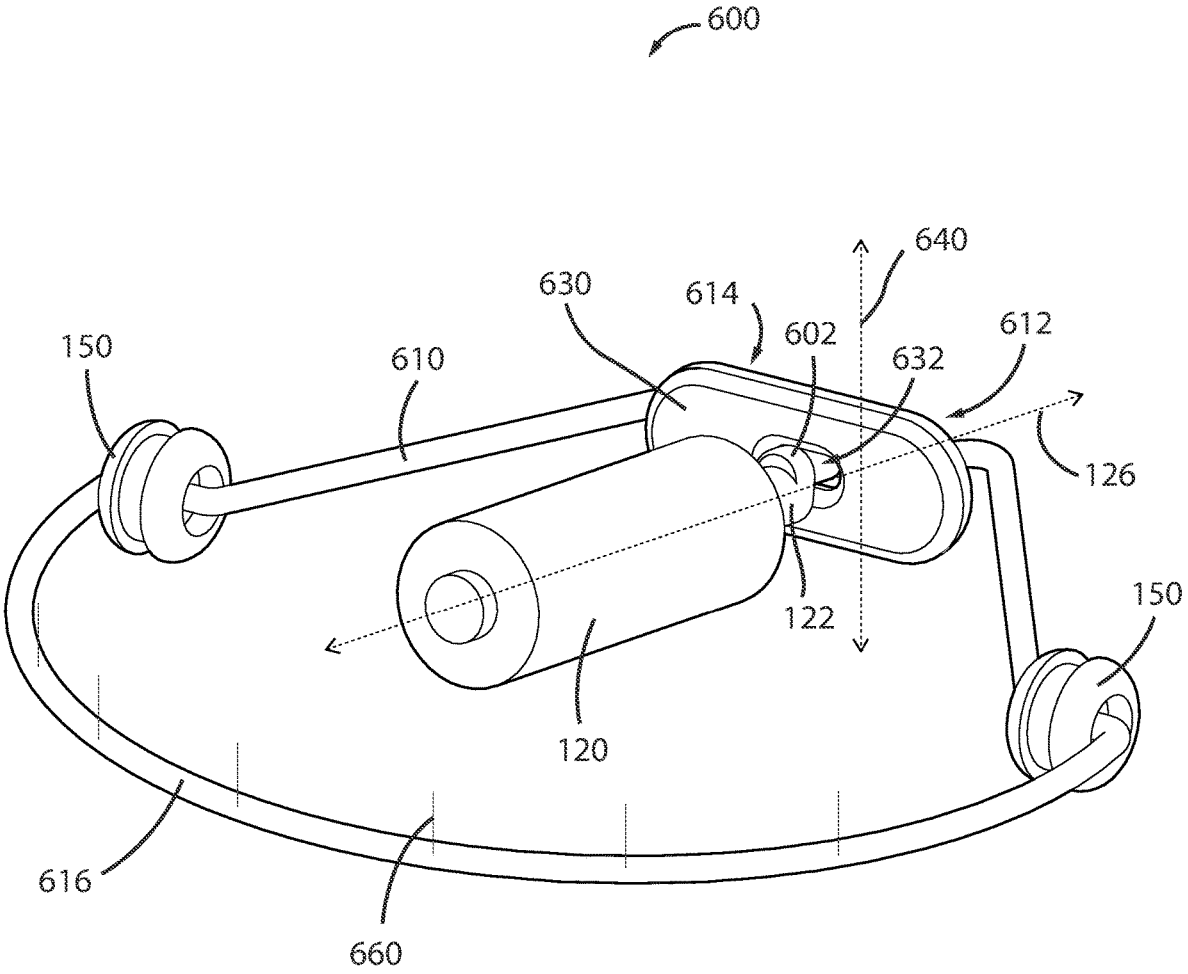
FIGS. 6A and 6B are diagrams of another example sexual stimulation device shown without and with a housing, respectively.
Figure 6B:
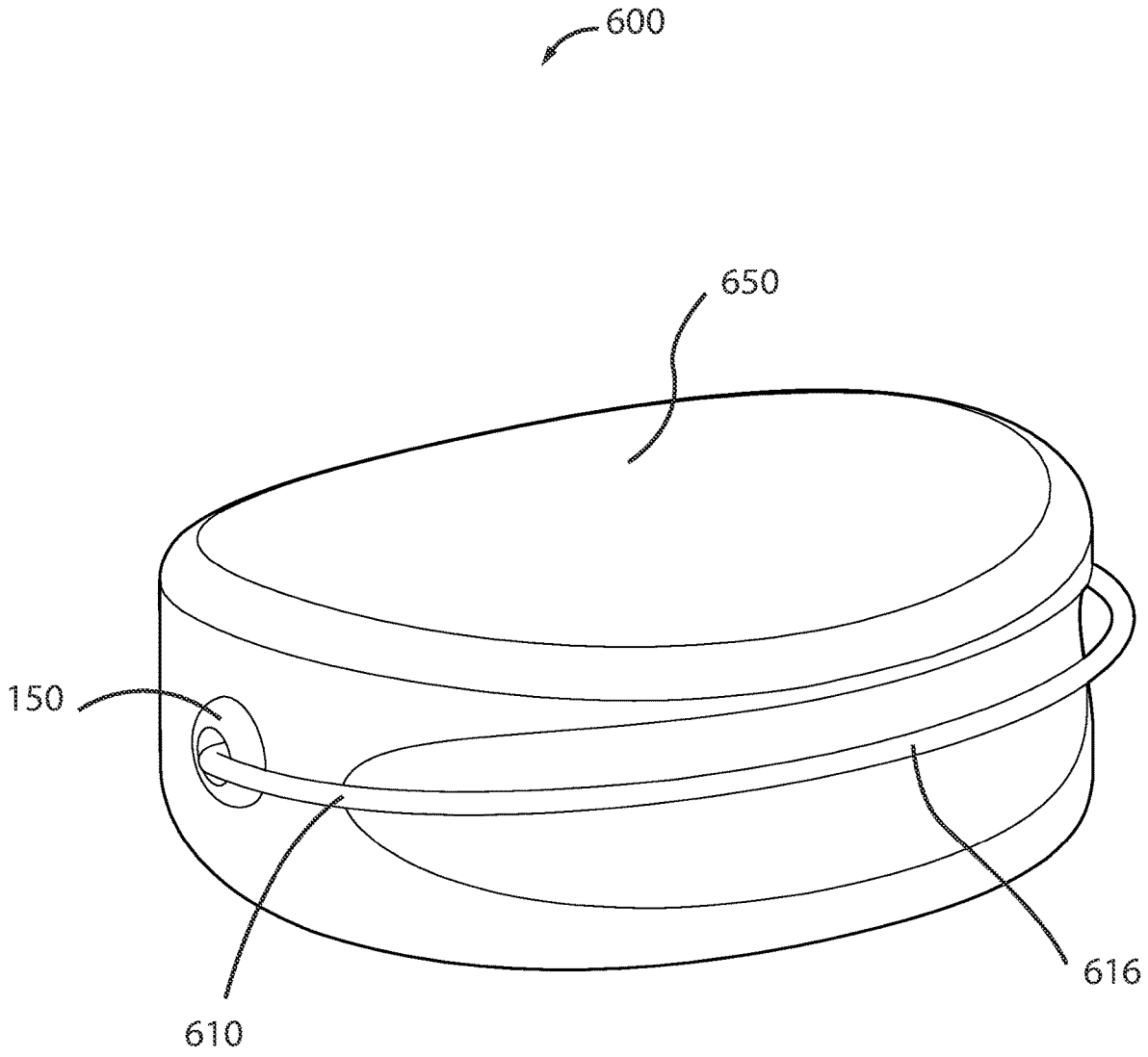

Further, although the foregoing examples show a stimulating element having a tip that traverses in a circular or elliptical path during operation, this need not be the case. In some cases, the tip of a stimulating element can move according to a linear path or any other type of path, depending on the implementation. As an example, another example sexual stimulation device 600 is shown in FIGS. 6A and 6B without and with a housing 650, respectively. For illustrative purposes, only a drive module 120, a coupling element 630, a stimulating element 610, and two fulcrums 150 are shown.

In a similar manner as described with respect to FIG. 1A, the example sexual stimulation device 600 shown in FIGS. 6A and 6B includes a drive module 120 that is coupled to the stimulating element 610 through the coupling element 630, such that movement of the drive module 120 results in a corresponding movement of the stimulating element 610. However, in this example, the drive element 122 of the drive module 120 includes an extension portion 602 that is off-set from the rotational axis 126. This extension portion is dimensioned such that it slots into a horizontally extending aperture 632 of the coupling element 630. Thus, when the drive element 122 rotates, the extension portion 602 slides horizontally along the aperture 632, but applies an upward or downward force on the coupling element 630.

The coupling element 630 is rotationally locked (e.g., with respect to the housing 650), but can translate freely in the vertical dimension 640. Thus, as the drive element 122 rotates, the upward or downward force applied by the extension portion 602 causes the coupling element 630 to move upward or downward. Accordingly, a continuous rotation of the drive element 122 causes the coupling element 630 to cyclically move upward or downward according to a particular period. In some cases, the coupling element 630 can be secured to a sliding track (e.g., a track defined by the housing 650), such that it does not rotate with respect to the housing 650, but can translate in the vertical dimension 640.

In this example, the stimulating element 610 is bent, such that a first end 612 and a second end 614 of the stimulating element 610 are each linked to the coupling element 630. Thus, movement of the coupling element 630 also results in a corresponding movement of the stimulating element 610.

In a similar manner as described with respect to FIG. 1A, the fulcrums 150 also dictate the degree to which the stimulating element 610 moves in response to movement of the drive module 120. For example, when the drive module 120 rotates the drive element 122, the coupling element 630 is forced upward by the extension portion 602. Correspondingly, the ends 612 and 614 of the stimulating element 610 are also moved upward, causing the stimulating element 610 to pivot at their point of contact with the fulcrums 150. As a result, the medial portion 616 of the stimulating element 610 is moved downward. Similarly, as the drive module 120 continues to rotate the drive element 122, the coupling element 630 is forced downward by the extension portion 602. Correspondingly, the ends 612 and 614 of the stimulating element 610 are also moved downward, causing the stimulating element 610 to pivot at their point of contact with the fulcrums 150. As a result, the medial portion 616 of the stimulating element 610 is moved upward. The range of motion of the stimulating element 610 is illustrated as lines 660.

The example sexual stimulation device 600 shown in FIG. 6A is shown with a housing 650 in FIG. 6B. Here, the housing 650 fully encloses several of the components of the sexual stimulation device 600 (e.g., the power supply 110, the drive module 120, and the coupling element 630), but only partially encloses the stimulating element 610 and the fulcrums 150. As the medial portion 616 is exposed and not enclosed by the housing 650, the user can directly place the medial portion 616 against her body.

Figure 7A:
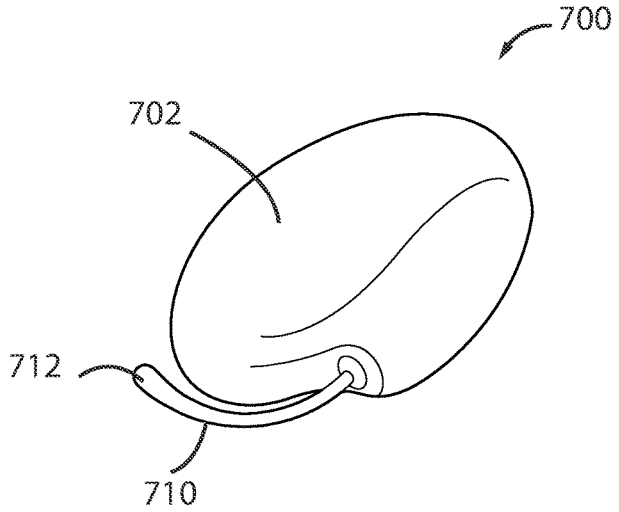
FIGS. 7A-C are diagrams of other example sexual stimulation devices.
Figure 7B:
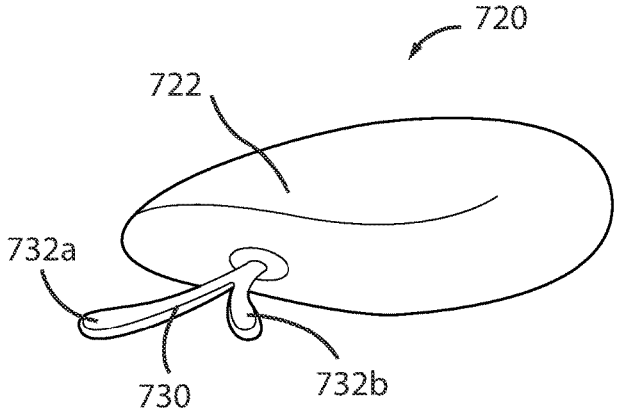
Figure 7C:
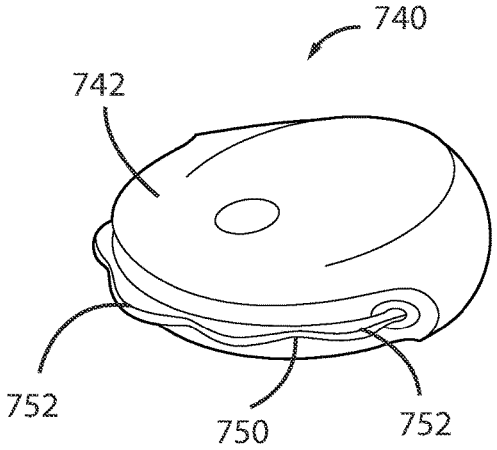

Although the foregoing examples show example stimulating elements, these are also merely illustrative examples. In practice, a sexual stimulation device can have different stimulating elements, depending on the implementation. For example, FIG. 7A shows an example sexual stimulation device 700 having a stimulating element 710 that extends from a housing 702 and enlarges gradually towards an end 712. As another example, FIG. 7B shows another example sexual stimulation device 720 having a stimulating element 730 that extends from a housing 722 and bifurcates into top ends 732*a-b*. As yet another example, FIG. 7C shows a sexual stimulation device 740 having a stimulating element 750 that extends from a housing 742 that includes several undulations 752 along its length. Other variations or combinations of variations are also possible, depending on the implementation.

Further still, although the foregoing examples show stimulating elements linked to coupling elements 130 at points offset from the rotational axes of the drive elements 122, this need not be in the case. For example, in some implementations, a stimulating element can be linked to a coupling element 130 at a point along the rotational axis of the drive element 122. In these implementations, the sexual stimulation device need not include a fulcrum 150. Instead, the stimulating element can be bent or curved away from the rotational axes of the drive element 122, such that the end of the stimulating element opposite the drive element 122 traverses a circular path when the drive module 120 is active. The path of the end of the stimulating element opposite the drive element 122 can be adjusted, for example, by modifying the bending or curvature of the stimulating element.

Figure 8:
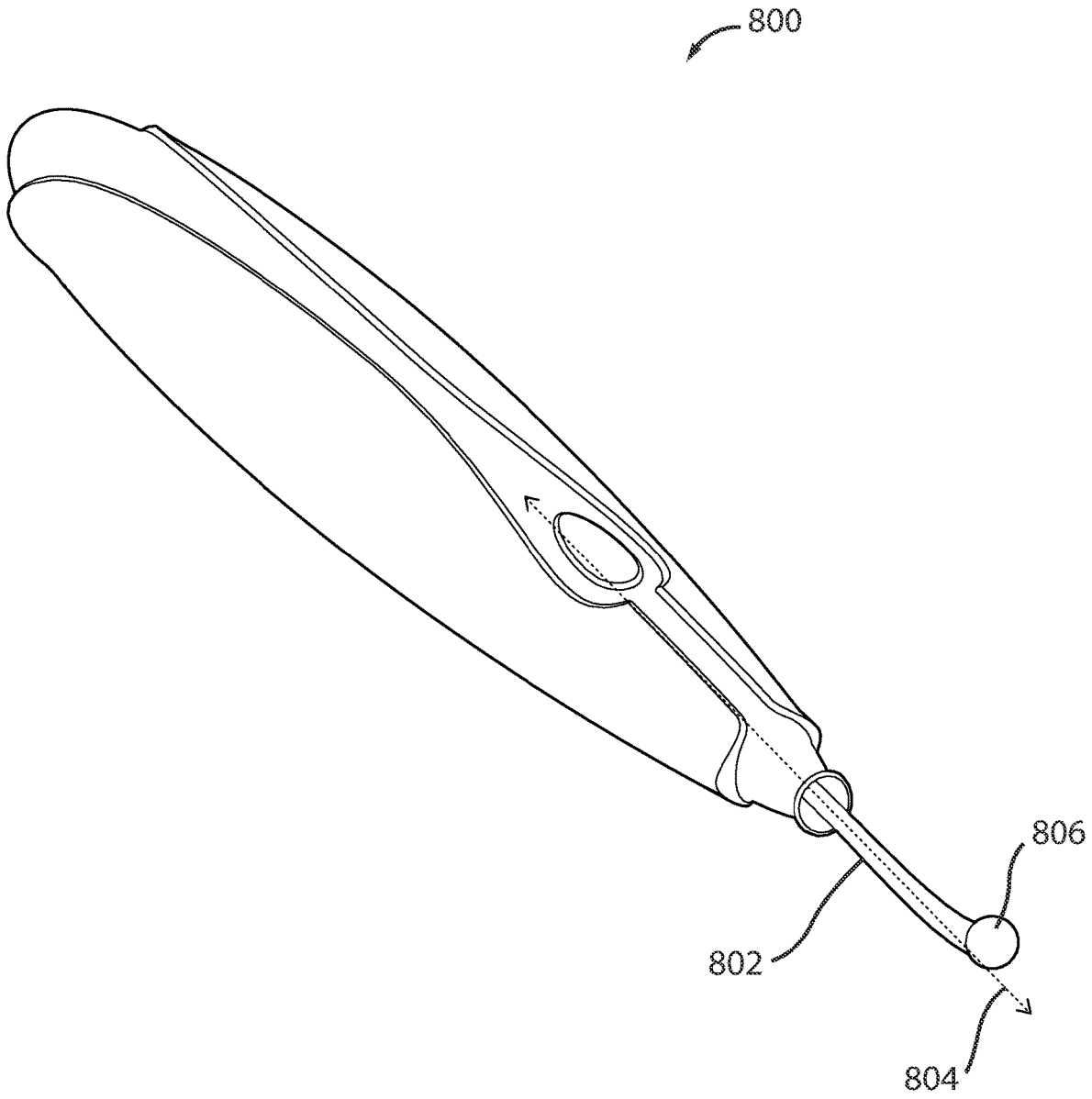
FIG. 8 is a diagram of another example sexual stimulation device.
Figure 9A:
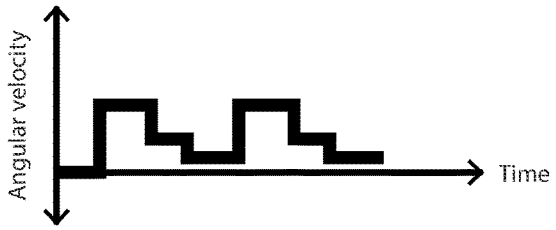
FIGS. 9A-G are diagrams of example patterns of operation for a drive element.
Figure 9C:
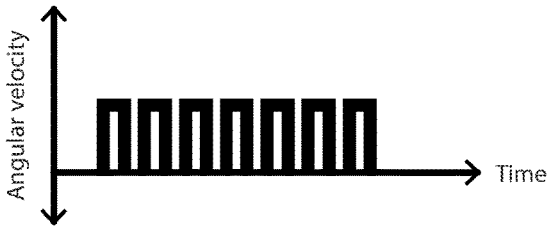
Figure 9B:
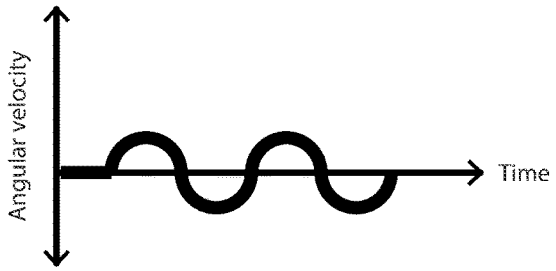
Figure 9D:
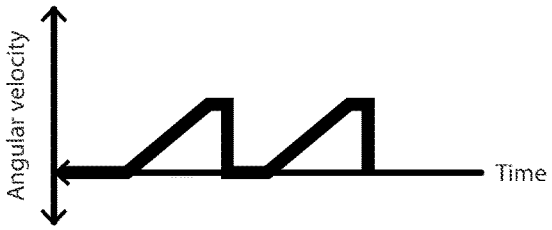
Figure 9E:
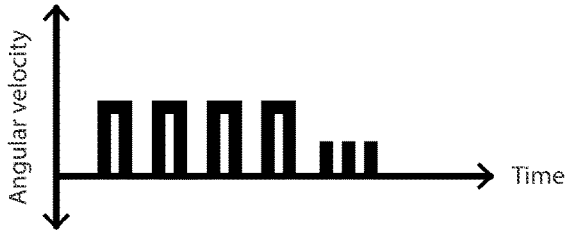
Figure 9G:
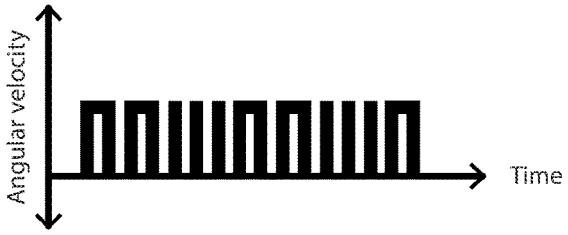
Figure 9F:
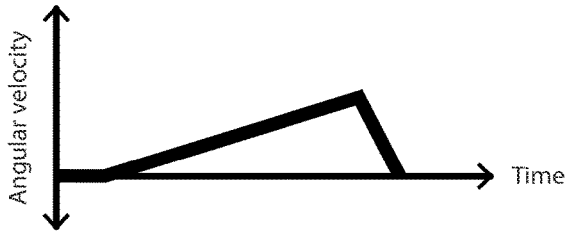

As an example, a sexual stimulation device 800 shown in FIG. 8. In this example, the sexual stimulation device 800 includes a stimulating element 802 that is bent or curved away from the rotational axis 804 of the drive element, such that the end of the stimulating element 806 traverses a circular path when the drive module is active. As described above, in some implementations, when a drive module is active, the drive module can periodically rotate a drive element according to a particular pattern (e.g., according to a particular angular velocity, duty cycle, or waveform). As examples, FIGS. 9A-G show several different patterns 900*a-g*, respectively, each having different angular velocities, duty cycles, and/or waveforms. In some cases, a sexual stimulation device can allow to user to select from among several different patterns so that the user can customize her experience.

Figure 10A:
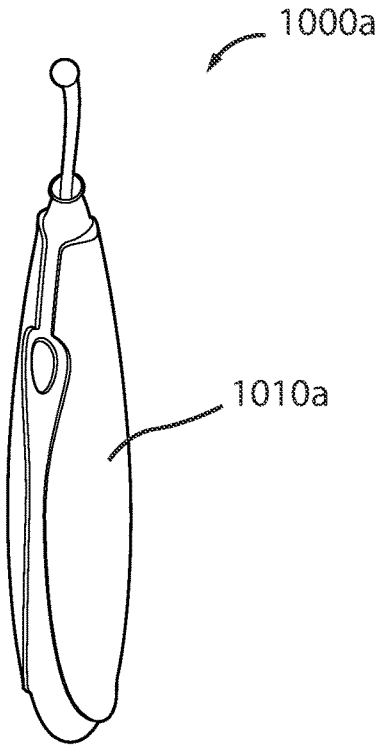
FIGS. 10A-D are diagrams of other example sexual stimulation devices.
Figure 10B:
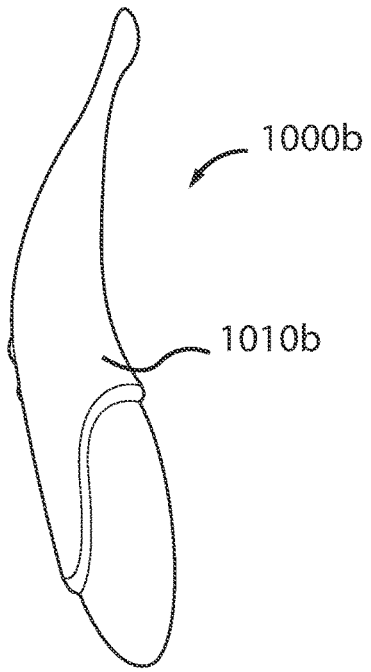
Figure 10C:
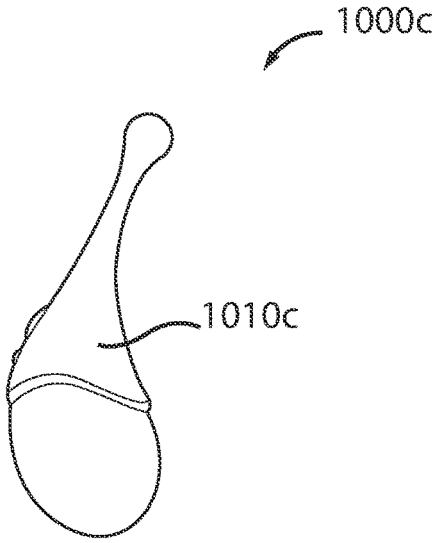
Figure 10D:
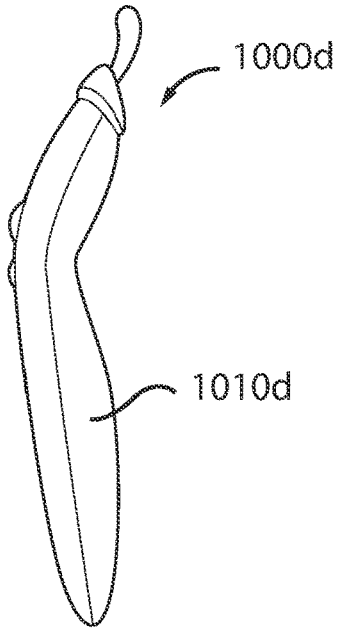

Further, although example housings are shown above, these are merely illustrative examples. In practice, housings having different arrangements are also possible, depending on the implementation. As examples, FIGS. 10A-D show sexual stimulation devices 1000*a-d*, each having a different housing 1010*a-d*, respectively. As shown in FIGS. 10B and 10C, in some implementations, a sexual stimulation device can have a housing with an integral sheath enclosing an end of a stimulating element.

Figure 11:
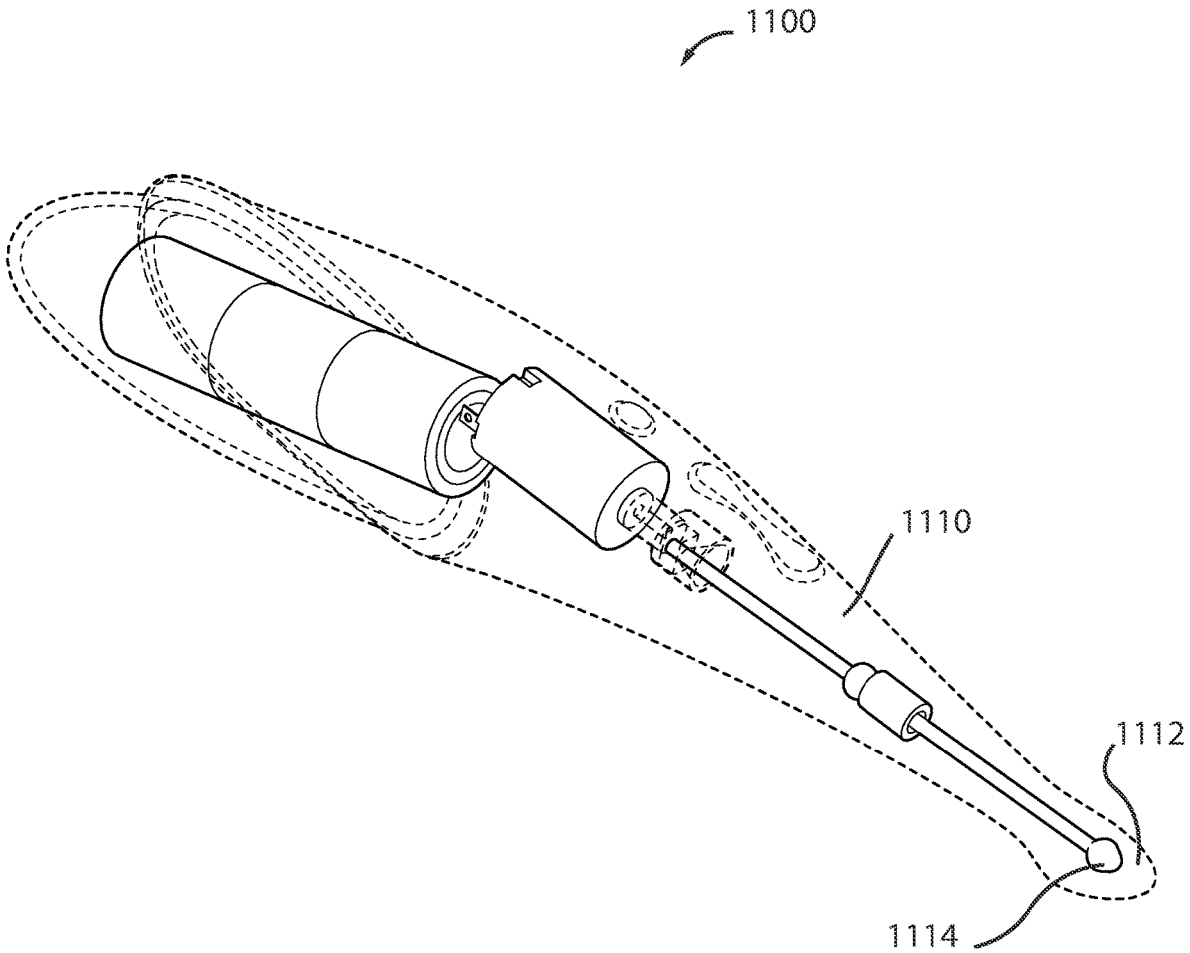
FIG. 11 is a diagram of another example sexual stimulation device.

As another example, FIG. 11 shows a sexual stimulation device 1100 having a housing 1110. For illustrative purposes, the housing 1110 is depicted as transparent. However, in practice, portions of the housing 1110 can be transparent, translucent, and/or opaque, depending on the implementation. As shown in FIG. 11, the housing 1110 has an integral sheath 1112 enclosing an end 1114 of a stimulating element.

Further still, although the foregoing examples show sexual stimulation devices having a single drive module 120, this also need not be the case. In some cases a sexual stimulation device can include multiple drive modules 120 (e.g., two, three, four, or move) operating independently or in combination in order to provide a particular effect.

Further still, although several of the foregoing example sexual simulation devices have a fulcrum that is separate and distinct from the housing (e.g., as shown in FIG. 1A), this need not be the case. In some cases, the fulcrum and the housing can be integrally formed as a single component. As an example, the housing can be configured to define an aperture (e.g., similar to the aperture 152 shown in FIG. 1C), such that when the end of the stimulating element is offset from the rotational axis of the drive module in a direction orthogonal to the rotational axis, the housing itself causes the stimulating element to pivot at their point of contact. As a result, the ends of the stimulating element are each displaced in opposite directions. Thus, as one end of the stimulating element traverses a circular path about the rotational axis, the opposite end likewise traverses a circular path about the rotational axis. This configuration may be beneficial, as it reduces the number of parts in the sexual simulation device, and can make the device easier to manufacture or service.

Figure 12A:
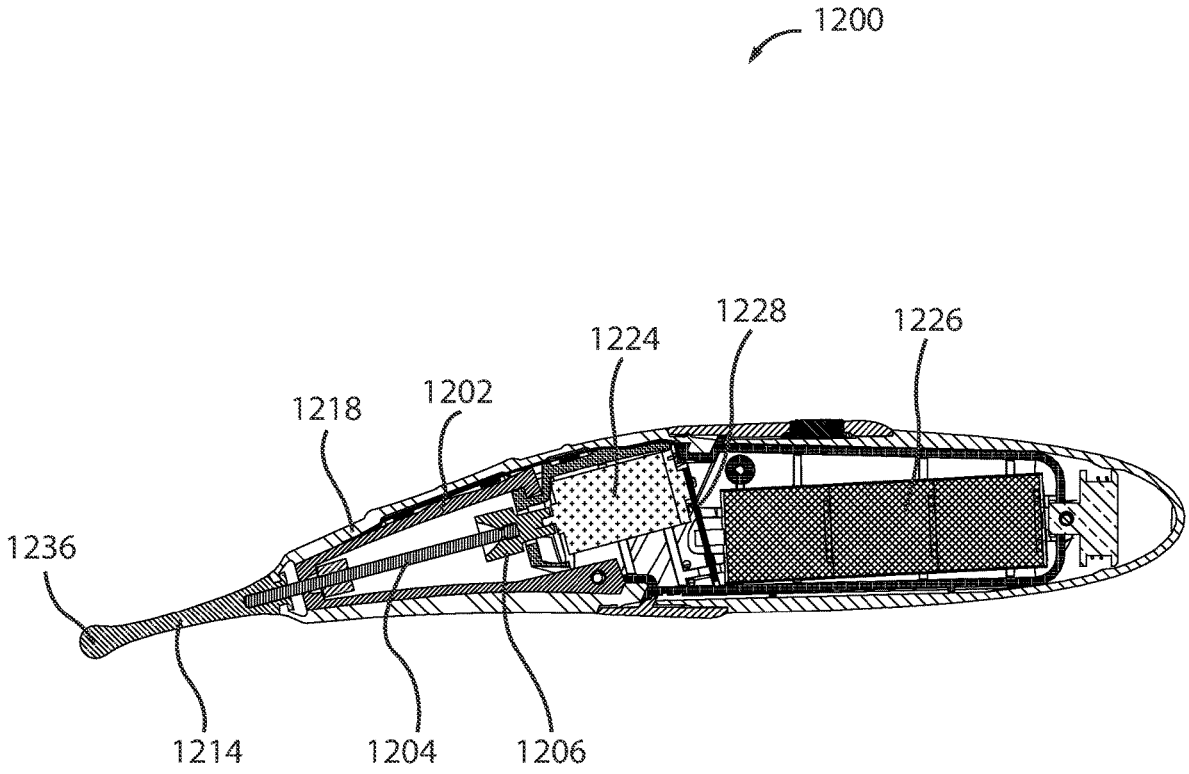
FIGS. 12A-B are diagrams of another example sexual stimulation device.

As an example, FIG. 12A shows a cross-sectional view of a sexual stimulation device 1200. A portion of the sexual stimulation device 1200 is shown in greater detail in FIG. 12B. In this example, the sexual stimulation device 1200 includes an inner housing 1202 that encloses the components of the sexual stimulation device 1200, including a stimulating element 1204, a coupling element 1206, a drive module 1224, a power supply 1226, and a control module 1228. The stimulating element 1204, the coupling element 1206, the drive module 1224, the power supply 1226, and the control module 1228 can be similar to those described with respect to FIGS. 1A and 1B. For instance, the end 1208 stimulating element 1204 can be linked to the coupling element 1206 at a mounting point offset from the rotational axis of a drive module (e.g., through an off-center mount or hole on the coupling element 1206). Thus, rotation of the drive module and the coupling element 1206 causes the stimulating element 1204 to undergo periodic motion (e.g., a circular motion about a rotational axis).

The inner housing 1202 also defines an aperture 1210, through which the stimulating element 1204 is inserted. When the end 1208 of the stimulating element 1204 is offset in a direction orthogonal to the rotational axis of the drive module (e.g., in a direction outward from the page), the inner housing 1202 causes the stimulating element 1204 to pivot at their point of contact. As a result, the opposite end 1212 of the stimulating element is displaced in the opposite direction orthogonal to the rotational axis (e.g., in a direction inward into the page). Thus, as the end 1208 of the stimulating element 1204 traverses a circular path about a rotational axis, the opposite end 1212 likewise traverses a circular path about the rotational axis.

The end 1212 of the stimulating element 1204 is covered by a compliant member or sheath 1214. The compliant member or sheath 1214 can be similar to that described with respect to FIGS. 1A, 1D, and 1E. Accordingly, movement of the stimulating element 1204 causes a corresponding movement of the compliant member or sheath 1214, and the user can press the compliant member or sheath 1214 against her body in order to obtain sexual stimulation.

In some cases, the compliant member or sheath 1214 can be reversibly detachable from the sexual stimulation device 1200 (e.g., by reversibly inserting into an annular groove 1216 defined by an outer housing 1218). This can be beneficial, as it allows the user to remove and replace the compliant member or sheath 1214 during maintenance or cleaning. In some cases, a small crevice can be defined between the compliant member or sheath 1214 and the outer housing 1218. In other cases, the compliant member or sheath 1214 and the outer housing 1218 can converge seamlessly or nearly seamlessly, such that there is little or no space between them.

In some cases, the compliant member or sheath 1214, the stimulating element 1204, and the aperture 1210 can be configured to reduce or minimize the transference of vibration to the inner housing 1202 and/or the outer housing 1218. This can be beneficial as it can reduce the amount of noise that is generated by the sexual stimulation device 1200 during use. This can also be beneficial as it can make the device easier to handle and/or reduce a user's hand fatigue during use.

As an example, this can be achieved by minimizing or otherwise reducing the mass of the compliant member or sheath 1214 and/or the mass of the simulating element 1204 between the end 1208 and its point of pivot at the aperture 1210, while also having sufficiently high masses to provide effective stimulation to a user. For instance, in some cases, the mass of the compliant member or sheath 1214 can be approximately 2 g or less (e.g., 2.0 g, 1.9 g, 1.8 g, and so forth) and be constructed from a relatively low-density semi-rigid flexible material, such as a high durometer silicon, acrylonitrile butadiene styrene (ABS), polyether ether ketone (PEEK), Ultem (e.g., as produced by SABIC), or a thermal plastic elastomer TPE).

Further, in some cases, the mass of the stimulating element can be approximately 1.5 g or less (e.g., 1.5 g, 1.3 g, 1.1 g, 0.9 g, and so forth), and be constructed from a relatively stiff metal (e.g., steel, titanium, and so forth) or stiff plastic (e.g., Ultem, PEEK, and so forth). Further, the portion of the stimulating element 1204 between the outermost periphery of the outer housing 1218 and its pivot point at the aperture 1210 (labeled as length 1230) can be approximately 7.0 mm or less (e.g., 7.0 g, 6.5 g, 6.0 g, 5.5 g, 5.0 g, and so forth).

In some cases, the length of the stimulating element 1204 from the end 1208 to its pivot point (labeled as length 1232) can be approximately equal to the length from the pivot point of the stimulating element to the end of the compliant member or sheath 1214 (labeled as length 1234) (e.g., within 1 mm, 2 mm, 3 mm, 4 mm, 5 mm of each other). Thus, the amplitude of oscillation of the end 1208 of the stimulating element 1204 is approximately the same as the amplitude of oscillation of the end 1236 of the compliant member or sheath 1214. As an example, the length 1230 can be approximately 5 mm, the length 1232 can be approximately 35 mm, and the length 1234 can be approximately 38 mm. The end 1236 and the end 1208 can each be offset from the axis of rotation by approximately 1.2 mm, resulting in an elliptical range of motion with a major axis of approximately 2.4 mm (e.g., 2.3 mm, 2.4 mm, 2.5 mm, and so forth). Although example lengths are provided, there are merely illustrative examples. Other lengths are also possible, depending on the implementation.

Figure 12B:
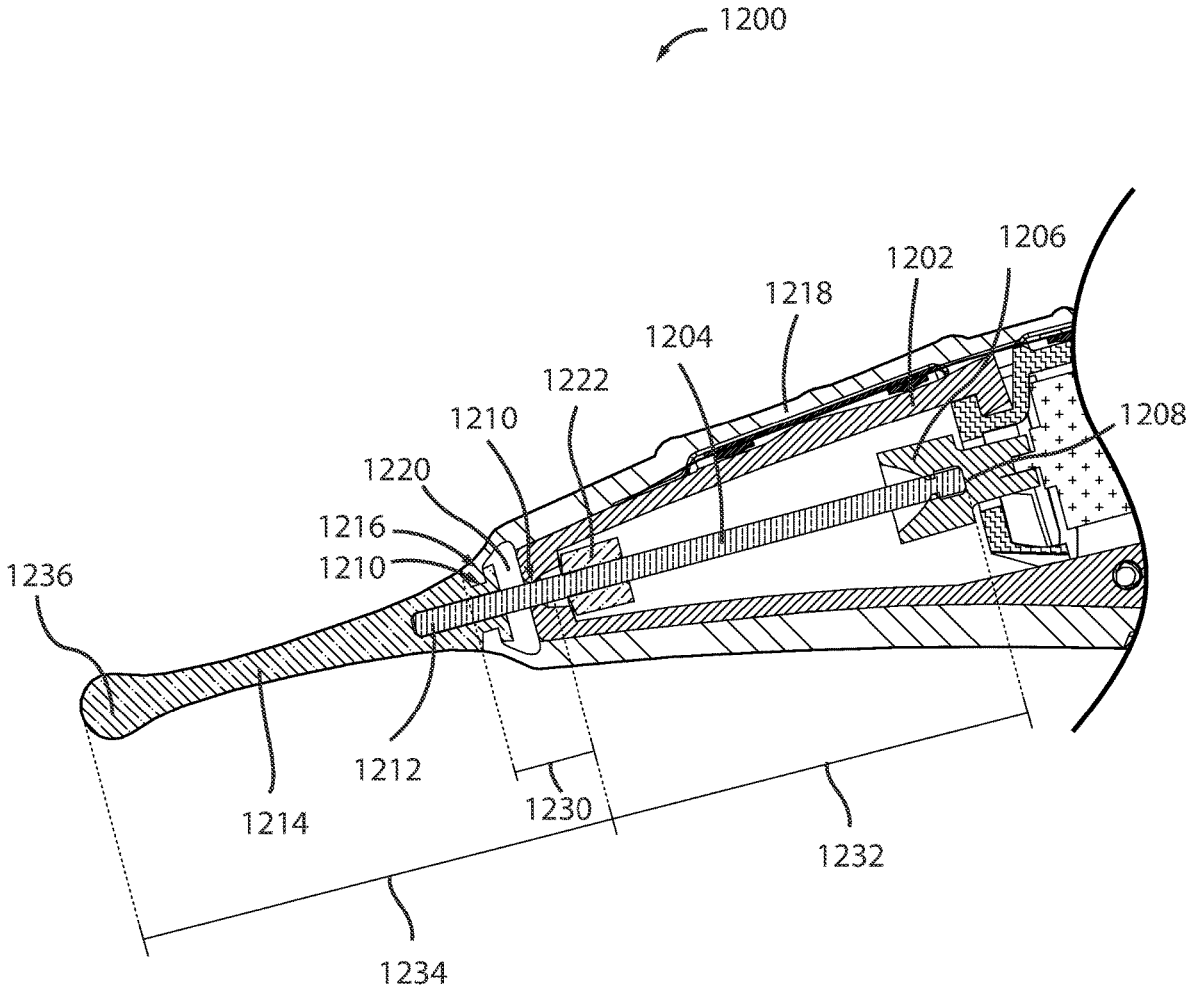

As shown in FIG. 12B, the compliant member or sheath 1214 can be rounded and enlarged at its end 1236. In some cases, the diameter of the end 1236 can be between approximately 2 mm and 5 mm. The compliant member or sheath 1214 can sufficiently stiff to deliver stimulation to the user, while remaining flexible enough to withstand being dropped without breaking or permanently bending. In some cases, the compliant member or sheath 1214 can be relatively more rigid than flexible. In some cases, the compliant member can be coated with a different material (e.g., a low durometer silicon material) and/or constructed using multiple different components (e.g., an inner layer of high durometer silicon, and an outer layer of low durometer silicon).

Further, the size and shape of the compliant member or sheath 1214 can differ, depending on its intended use. For example, as described above, the compliant member or sheath 1214 can be rounded and enlarged at its end 1236, and the diameter of the end 1236 can be between approximately 2 mm and 5 mm. This configuration can be used, for example, for clitoral stimulation. As another example, in some cases, the compliant member or sheath 1214 can be sized and shaped to insert into a user's urethra in provide urethral stimulation. For instance, compliant member or member or sheath 1214 can have a diameter between 6 mm and 8 mm, either at the end 1236, along a portion of its extension, or along its entirety. In some cases, the compliant member or sheath 1214 can be interchangeable by the user, thereby enabling the user to customize the sexual stimulation device based on her preferences.

As shown in FIG. 12B, the sexual stimulation device 1200 can also include a seal 1220 to prevent the ingress of moisture into the sexual stimulation device 1200. As an example, the seal 1220 can be placed between the inner housing 1202 and the outer housing 1218 to prevent moisture from entering into the inner housing 1202. In some cases, the seal 1220 can be integrally formed with the inner housing 1202 or the outer housing 1218. The seal 1220 can be constructed from a moisture-resistant material, such as rubber, plastic, silicone, glass, metal, or other such material. In some cases, instead of or in addition to the seal 1220, an adhesive can be used to join the compliant member or sheath 1214 to the outer housing 1218 to prevent the ingress of moisture.

As shown in FIGS. 12A-B, the sexual stimulating device 1200 can include two housings: an inner housing 1202 and an outer housing 1218. This can be beneficial, for example, as it allows one housing (e.g., the inner housing 1202) to be formed from a relatively rigid material to support the structure of the sexual situation device 1200, while allowing for the other housing (e.g., the outer housing 1218) to be formed from a relatively soft material for user comfort. However, in some cases, the inner housing 1202 and the outer housing 1218 can be integrally formed as a single housing structure.

As shown in FIG. 12B, in some cases, the stimulating element 1204 can include a protrusion 1222. This protrusion 1222 can be positioned along the length of the stimulating element 1204 such that it abuts the inner housing 1202 near the aperture 1210. This can be beneficial, for example, as it prevents the stimulating element 1204 from escaping the inner housing 1202 through the aperture 1210. In some cases, the stimulating element 1204 can be retained within the sexual stimulating device 1200 by bonding the stimulating element 1204 to the compliant member or sheath 1214 (e.g., permanently or substantially permanently), and bonding the compliant member or sheath 1214 to the outer housing 1218 (e.g., permanently or substantially permanently). In some cases, the stimulating element 1204, compliant member or sheath 1214, and the outer housing 1218 can be bonded in this manner, irrespective of the presence of the protrusion 1222.

Although FIGS. 12A-B depict the stimulating element 1204 as being inserted into the compliant member or sheath 1214, this need not be the case. In some implementations, the stimulating element 1204 and the compliant member or sheath 1214 can coupled in other ways, such as through a butt joint.

A number of embodiments have been described. Nevertheless, it will be understood that various modifications may be made without departing from the spirit and scope of the disclosure. Accordingly, other embodiments are within the scope of the following claims.

What is claimed is:

1. A sexual stimulation device comprising:

a drive module comprising one or more motors;

a coupling element coupled to the drive module along a rotational axis of the drive module, the coupling element further comprising a mounting point that is off-set from the rotational axis of the drive module;

a stimulating element comprising:

a first end coupled to the mounting point of the coupling element in a manner such that the first end of the stimulating element moves along a first path when the drive module is operated, and, a second end opposite the first end;

a fulcrum disposed at a first point along an extension of the stimulating element such that the stimulating element pivots about the first point and the second end of the stimulating element translates according to a second path; and a compliant member coupled to the second end of the stimulating element.

2. The sexual stimulation device of claim 1, wherein the first path and the second path are both generally circular.

3. The sexual stimulation device of claim 1, wherein the first path is generally circular and the second path is generally elliptical.

4. The sexual stimulation device of claim 1, wherein the first path is generally circular and the second path is generally linear.

5. The sexual stimulation device of claim 1, wherein the compliant member comprises a sheath.

6. The sexual stimulation device of claim 1, wherein the compliant member comprises a housing.

7. The sexual stimulation device of claim 1, wherein the second path has a radius in a range between 0.5 mm to 2.5 mm.

8. The sexual stimulation device of claim 1, wherein the second end of the stimulating element moves along the second path at a frequency in a range between 1000 Hz and 9000 Hz.

9. The sexual stimulation device of claim 1, wherein the fulcrum defines an aperture, and wherein the stimulating element extends through the aperture of the fulcrum.

10. The sexual stimulation device of claim 1, wherein a distance between the first point and the first end of the stimulating element is approximately equal to a distance between the first point and the second end of the stimulating element.

11. The sexual stimulation device of claim 1, wherein a distance between the first point and the first end of the stimulating element is shorter than a distance between the first point and the second end of the stimulating element.

12. The sexual stimulation device of claim 1, wherein a distance between the first point and the first end of the stimulating element is longer than a distance between the first point and the second end of the stimulating element.

13. The sexual stimulation device of claim 1, wherein the stimulating element comprises a rod extending in a single dimension.

14. The sexual stimulation device of claim 1, wherein the stimulating element comprises a rod having at least one bend.

15. The sexual stimulation device of claim 1 wherein the coupling element is further comprised of a cavity having an opening wider than an opening of the mounting point, the cavity being off-set from the rotational axis of the drive module.

16. The sexual stimulation device of claim 1, where the stimulating element has a diameter in a range between 0.5 mm and 7 mm.

17. The sexual stimulation device of claim 1, wherein the fulcrum comprises an aperture.

18. The sexual stimulation device of claim 17 wherein the fulcrum is comprised of two notches surrounding the aperture, each of the notches having a diameter larger than the aperture to allow the stimulating element to pivot about the fulcrum.

19. The sexual stimulation device of claim 6, wherein the fulcrum comprises an annular groove to provide a mounting point for fixing the fulcrum to the housing.

* * * * *